US010802411B2

(12) United States Patent
Iwashita et al.

(10) Patent No.: US 10,802,411 B2
(45) Date of Patent: Oct. 13, 2020

(54) ELECTROPHOTOGRAPHIC PHOTOSENSITIVE MEMBER, PROCESS CARTRIDGE, AND IMAGE FORMING APPARATUS

(71) Applicant: KYOCERA Document Solutions Inc., Osaka (JP)

(72) Inventors: Yuko Iwashita, Osaka (JP); Kazunari Hamasaki, Osaka (JP); Kazutaka Sugimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/496,220

(22) PCT Filed: Mar. 16, 2018

(86) PCT No.: PCT/JP2018/010490
§ 371 (c)(1),
(2) Date: Sep. 20, 2019

(87) PCT Pub. No.: WO2018/198590
PCT Pub. Date: Nov. 1, 2018

(65) Prior Publication Data

US 2020/0057396 A1 Feb. 20, 2020

(30) Foreign Application Priority Data

Apr. 28, 2017 (JP) ..... 2017-089392
Dec. 22, 2017 (JP) ..... 2017-246064

(51) Int. Cl.
*G03G 5/06* (2006.01)
*G03G 5/05* (2006.01)

(52) U.S. Cl.
CPC ..... *G03G 5/0614* (2013.01); *G03G 5/0564* (2013.01); *G03G 5/0616* (2013.01); *G03G 5/06147* (2020.05); *G03G 5/061443* (2020.05); *G03G 5/061446* (2020.05); *G03G 2215/00957* (2013.01)

(58) Field of Classification Search
CPC ... G03G 5/0614; G03G 5/0564; G03G 5/0616
See application file for complete search history.

(56) References Cited

U.S. PATENT DOCUMENTS

| | | | | |
|---|---|---|---|---|
| 6,593,047 | B2 * | 7/2003 | Azuma | G03G 5/0564 430/56 |
| 8,980,507 | B2 * | 3/2015 | Shimizu | G03G 5/0609 430/56 |
| 9,285,692 | B2 | 3/2016 | Mizuta et al. | |
| 2002/0098428 | A1 * | 7/2002 | Watanabe | G03G 5/0564 430/56 |
| 2014/0093817 | A1 | 4/2014 | Mizuta et al. | |
| 2016/0357118 | A1 * | 12/2016 | Tsurumi | G03G 5/0578 |

FOREIGN PATENT DOCUMENTS

| | | | |
|---|---|---|---|
| JP | S56-135844 | A | 10/1981 |
| JP | 2002196517 | A * | 7/2002 |
| JP | 2012-208231 | A | 10/2012 |
| JP | 2013-029777 | A | 2/2013 |
| JP | 2014-071334 | A | 4/2014 |
| JP | 2014-092582 | A | 5/2014 |
| JP | 2014-130236 | A | 7/2014 |
| JP | 2016-090610 | A | 5/2016 |
| JP | 2018145145 | A * | 9/2018 |
| WO | 2017-061476 | A1 | 4/2017 |

OTHER PUBLICATIONS

English language machine translation of JP2002-196517. (Year: 2002).*

* cited by examiner

*Primary Examiner* — Christopher D Rodee
(74) *Attorney, Agent, or Firm* — Studebaker & Brackett PC

(57) ABSTRACT

An electrophotographic photosensitive member includes a photosensitive layer of a single layer. The photosensitive layer contains a charge generating material, a hole transport material, an electron transport material, and a binder resin. An optical response time is 0.05 milliseconds or longer and 0.85 milliseconds or shorter. The optical response time is a time from irradiation of a surface of the photosensitive layer charged to +800 V with pulse light having a wavelength of 780 nm to decay of a surface potential of the photosensitive layer from +800 V to +400 V. The pulse light has an intensity that allows the surface potential of the photosensitive layer to decay to +200 V from +800 V after 400 milliseconds elapse from the irradiation of the surface of the photosensitive layer charged to +800 V with the pulse light. The photosensitive layer has a Martens hardness at 50° C. of at least 160 N/mm$^2$.

11 Claims, 6 Drawing Sheets

ELECTROPHOTOGRAPHIC PHOTOSENSITIVE MEMBER, PROCESS CARTRIDGE, AND IMAGE FORMING APPARATUS

TECHNICAL FIELD

The present invention relates to an electrophotographic photosensitive member, a process cartridge, and an image forming apparatus.

BACKGROUND ART

Electrophotographic photosensitive members are used in electrographic image forming apparatuses. Examples of the electrophotographic photosensitive members include a multi-layer electrophotographic photosensitive member and a single-layer electrophotographic photosensitive member. An electrophotographic photosensitive member includes a photosensitive layer. The multi-layer electrophotographic photosensitive member includes as the photosensitive layer a charge generating layer having a charge generating function and a charge transport layer having a charge transport function. The single-layer electrophotographic photosensitive member includes as the photosensitive layer a single-layer photosensitive layer having a charge generating function and a charge transport function.

An electrophotographic photosensitive member disclosed in Patent Literature 1 contains at least one polyarylate resin having a specific structure as a binder resin.

CITATION LIST

Patent Literature

[Patent Literature 1]

Japanese Patent Application Laid-Open Publication No. S56-135844

SUMMARY OF INVENTION

Technical Problem

However, the present inventors' study revealed that the electrophotographic photosensitive member disclosed in Patent Literature 1 insufficiently inhibits black spot generation on a formed image and an image defect resulting from exposure memory.

The present invention has been made in view of the foregoing and has its object of providing an electrophotographic photosensitive member that inhibits black spot generation on a formed image and an image defect resulting from exposure memory. The present invention has another object of providing an image forming apparatus and a process cartridge that inhibit black spot generation on a formed image and an image defect resulting from exposure memory.

Solution to Problem

An electrophotographic photosensitive member according to the present invention includes a conductive substrate and a photosensitive layer of a single layer. The photosensitive layer contains a charge generating material, a hole transport material, an electron transport material, and a binder resin. An optical response time is 0.05 milliseconds or longer and 0.85 milliseconds or shorter. The optical response time is a time from irradiation of a surface of the photosensitive layer charged to +800 V with pulse light having a wavelength of 780 nm to decay of a surface potential of the photosensitive layer from +800 V to +400 V. The pulse light has a light intensity that allows the surface potential of the photosensitive layer to decay to +200 V from +800 V after 400 milliseconds elapse from the irradiation of the surface of the photosensitive layer charged to +800 V with the pulse light. The photosensitive layer has a Martens hardness at 50° C. of at least 160 $N/mm^2$.

A process cartridge according to the present invention includes the electrophotographic photosensitive member described above.

An image forming apparatus according to the present invention includes an image bearing member, a charger, a light exposure section, a developing section, and a transfer section. The charger charges a surface of the image bearing member. The light exposure section exposes the charged surface of the image bearing member to light to form an electrostatic latent image on the surface of the image bearing member. The developing section develops the electrostatic latent image into a toner image. The transfer section transfers the toner image onto a transfer target from the image bearing member. The charger charges the surface of the image bearing member to a positive polarity. The image bearing member is the electrophotographic photosensitive member described above.

Advantageous Effects of Invention

The electrophotographic photosensitive member according to the present invention can inhibit black spot generation on a formed image and an image defect resulting from exposure memory. The process cartridge and the image forming apparatus according to the present invention can also inhibit black spot generation on a formed image and an image defect resulting from exposure memory.

DESCRIPTION OF EMBODIMENTS

Figure 1A:
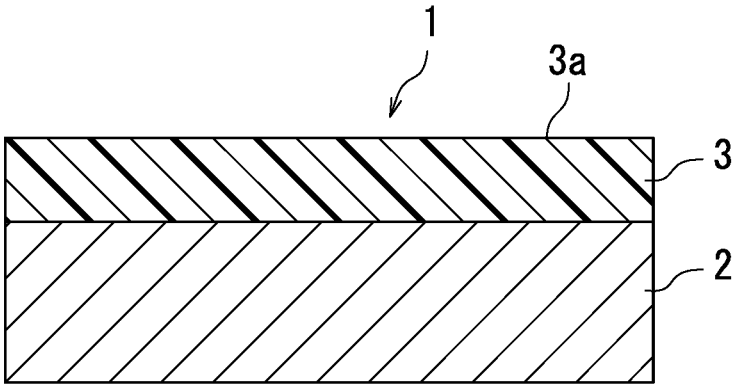
FIG. 1A is a partial cross-sectional view of an example of an electrophotographic photosensitive member according to an embodiment of the present invention.

The following describes an embodiment of the present invention in detail. The present invention is not in any way limited by the following embodiment. The present invention can be practiced within a scope of objects of the present invention with alterations made as appropriate. Although some overlapping explanations may be omitted as appropriate, such omission does not limit the gist of the present invention.

In the following description, the term "-based" may be appended to the name of a chemical compound to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. The phrases "optionally having a group", "having a group", "optionally having a halogen atom", and "having a halogen atom" respectively mean "optionally substituted by a group", "substituted by a group", "optionally substituted by a halogen atom", and "substituted by a halogen atom".

In the following, a halogen atom, an alkyl group having a carbon number of at least 1 and no greater than 6, an alkyl group having a carbon number of at least 1 and no greater than 5, an alkyl group having a carbon number of at least 1 and no greater than 4, an alkyl group having a carbon number of at least 1 and no greater than 3, an alkenyl group having a carbon number of at least 2 and no greater than 4, an alkoxy group having a carbon number of at least 1 and no greater than 6, an aryl group having a carbon number of at least 6 and no greater than 14, an aryl group having a carbon number of at least 6 and no greater than 10, an aralkyl group having a carbon number of at least 7 and no greater than 20, a heterocyclic group having at least 5 members and no greater than 14 members, and a cycloalkylidene group having a carbon number of at least 5 and no greater than 7 refer to the following unless otherwise stated.

Examples of a halogen atom as used herein include a fluorine atom, a chlorine atom, a bromine atom, and an iodine atom.

An alkyl group having a carbon number of at least 1 and no greater than 6, an alkyl group having a carbon number of at least 1 and no greater than 5, an alkyl group having a carbon number of at least 1 and no greater than 4, and an alkyl group having a carbon number of at least 1 and no greater than 3 as used herein each are an unsubstituted straight chain or branched chain alkyl group. Examples of the alkyl group having a carbon number of at least 1 and no greater than 6 include a methyl group, an ethyl group, an n-propyl group, an isopropyl group, an n-butyl group, a sec-butyl group, a tert-butyl group, a pentyl group, an isopentyl group, a neopentyl group, and a hexyl group. Examples of the alkyl group having a carbon number of at least 1 and no greater than 5 are the groups having a carbon number of at least 1 and no greater than 5 among the groups listed above as examples of the alkyl group having a carbon number of at least 1 and no greater than 6. Examples of the alkyl group having a carbon number of at least 1 and no greater than 4 are the groups having a carbon number of at least 1 and no greater than 4 among the above-listed examples of the alkyl group having a carbon number of at least 1 and no greater than 6. Examples of the alkyl group having a carbon number of at least 1 and no greater than 3 are the groups having a carbon number of at least 1 and no greater than 3 among the above-listed examples of the alkyl group having a carbon number of at least 1 and no greater than 6.

An alkenyl group having a carbon number of at least 2 and no greater than 4 as used herein is an unsubstituted straight chain or branched chain alkenyl group. The alkenyl group having a carbon number of at least 2 and no greater than 4 has one or two double bonds. Examples of the alkenyl group having a carbon number of at least 2 and no greater than 4 include an ethenyl group, a propenyl, a butenyl group, and a butadienyl group.

An alkoxy group having a carbon number of at least 1 and no greater than 6 as used herein is an unsubstituted straight chain or branched chain alkoxy group. Examples of the alkoxy group having a carbon number of at least 1 and no greater than 6 include a methoxy group, an ethoxy group, an n-propoxy group, an isopropoxy group, an n-butoxy group, a sec-butoxy group, a tert-butoxy group, a pentyloxy group, an isopentyloxy group, a neopentyloxy group, and a hexyloxy group.

An aryl group having a carbon number of at least 6 and no greater than 14 and an aryl group having a carbon number of at least 6 and no greater than 10 as used herein each are an unsubstituted aryl group. Examples of the aryl group having a carbon number of at least 6 and no greater than 14 include a phenyl group, a naphthyl group, an indacenyl group, a biphenylenyl group, an acenaphthylenyl group, an anthryl group, and a phenanthryl group. Examples of the aryl group having a carbon number of at least 6 and no greater than 10 include a phenyl group and a naphthyl group.

An aralkyl group having a carbon number of at least 7 and no greater than 20 as used herein is an unsubstituted aralkyl group. An example of the aralkyl group having a carbon number of at least 7 and no greater than 20 is an alkyl group having a carbon number of at least 1 and no greater than 6 and having an aryl group having a carbon number of at least 6 and no greater than 14.

A heterocyclic group having at least 5 members and no greater than 14 members as used herein is an unsubstituted heterocyclic group having at least 1 hetero atom besides carbon atoms. The hetero atom is at least one selected from a group consisting of a nitrogen atom, a sulfur atom, and an oxygen atom. Examples of the heterocyclic group having at least 5 members and no greater than 14 members include: a monocyclic heterocyclic group having 5 or 6 members including at least 1 and no greater 3 hetero atoms besides carbon atoms; a heterocyclic group in which two monocyclic heterocyclic rings such as above are condensed; a heterocyclic group in which a monocyclic heterocyclic ring such as above and a monocyclic hydrocarbon ring having 5 or 6 members are condensed; a heterocyclic group in which 3 monocyclic heterocyclic rings such as above are condensed; a heterocyclic group in which 2 monocyclic heterocyclic rings and a single monocyclic hydrocarbon ring having 5 or 6 members are condensed; and a heterocyclic group in which a single monocyclic heterocyclic ring such as above and 2 monocyclic hydrocarbon rings having 5 or 6 members are condensed. Examples of the heterocyclic group having at least 5 members and no greater than 14 members include a piperidinyl group, a piperazinyl group, a morpholinyl group, a thiophenyl group, a furanyl group, a pyrrolyl group, an imidazolyl group, a pyrazolyl group, an isothiazolyl group, an isoxazolyl group, an oxazolyl group, an isoxazolyl group, a thiazolyl group, an isothiazolyl group, a furazanyl group, a pyranyl group, a pyridyl group, a pyridazinyl group, a pyrimidinyl group, a pyrazinyl group, an indolyl group, a 1H-indazolyl group, an isoindolyl group, a chromenyl group, a quinolinyl group, an isoquinolinyl group, a purinyl group, a pteridinyl group, a triazolyl group, a tetrazolyl group, a 4H-quinolizinyl group, a naphthyridinyl group, a benzofuranyl group, a 1,3-benzodioxolyl group, a benzoxazolyl group, a benzothiazolyl group, a benzimidazolyl group, a carbazolyl group, a phenanthridinyl group, an acridinyl group, a phenazinyl group, and a phenanthrolinyl group.

A cycloalkylidene group having a carbon number of at least 5 and no greater than 7 as used herein is an unsubstituted cycloalkylidene group. Examples of the cycloalkylidene group having a carbon number of at least 5 and no greater than 7 include a cyclopentylidene group, a cyclohexylidene group, and a cycloheptylidene group. The cycloalkylidene group having a carbon number of at least 5 and no greater than 7 is represented by the following general formula. In general formula, t represents an integer of at least 1 and no greater than 3, and asterisks each represent a bond.

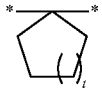

<Electrophotographic Photosensitive Member>

Figure 1B:
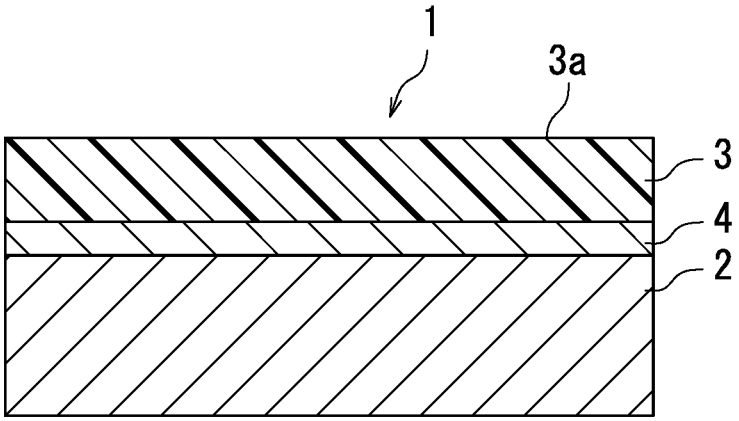
FIG. 1B is a partial cross-sectional view of an example of the electrophotographic photosensitive member according to the embodiment of the present invention.

The present embodiment relates to an electrophotographic photosensitive member (also referred to below as a photosensitive member). The following describes a structure of a photosensitive member 1 with reference to FIGS. 1A and 1B. FIGS. 1A and 1B each are a cross-sectional view of an example of the photosensitive member 1 according to the present embodiment.

As illustrated in FIG. 1A, the photosensitive member 1 includes for example a conductive substrate 2 and a photosensitive layer 3. The photosensitive layer 3 is a single layer (one layer). The photosensitive member 1 is a single-layer electrophotographic photosensitive member including a photosensitive layer 3 of a single layer.

As illustrated in FIG. 1B, the photosensitive member 1 may include the conductive substrate 2, the photosensitive layer 3, and an intermediate layer 4 (undercoat layer). The intermediate layer 4 is disposed between the conductive substrate 2 and the photosensitive layer 3. The photosensitive layer 3 may be located directly on the conductive substrate 2 as illustrated in FIG. 1A. Alternatively, the photosensitive layer 3 may be located on the conductive substrate 2 with the intermediate layer 4 therebetween as illustrated in FIG. 1B. The intermediate layer 4 may be a single-layer intermediate layer or a multi-layer intermediate layer.

The photosensitive member 1 may include the conductive substrate 2, the photosensitive layer 3, and a protective layer (not illustrated). The protective layer is disposed on the photosensitive layer 3. The protective layer may be a single-layer protective layer or a multi-layer protective layer.

No particular limitations are placed on thickness of the photosensitive layer 3. The photosensitive layer 3 preferably has a thickness of at least 5 μm and no greater than 100 μm, and more preferably at least 10 μm and no greater than 50 μm. The structure of the photosensitive member 1 has been described so far with reference to FIGS. 1A and 1B. The following describes the photosensitive member further in detail.

<Photosensitive Layer>

The photosensitive layer contains a charge generating material, a hole transport material, an electron transport material, and a binder resin. The photosensitive layer may contain an additive as needed.

(Martens Hardness) The photosensitive layer has a Martens hardness at 50° C. of at least 160 N/mm$^2$. The Martens hardness of the photosensitive layer at 50° C. is a Martens hardness of the photosensitive layer when the temperature of the photosensitive layer is 50° C. As a result of the Martens hardness of the photosensitive layer at 50° C. being at least 160 N/mm$^2$, black spot generation on a formed image can be inhibited. When the Martens hardness of the photosensitive layer at 50° C. is less than 160 N/mm$^2$, black spots are generated on a formed image. Presumably, the reason therefor is as follows. When a photosensitive layer of a photosensitive member has a Martens hardness of less than 160 N/mm$^2$, a fine scratch or the like is readily formed in the photosensitive layer upon the photosensitive member coming into contact with a member of an image forming apparatus. An external additive detached from a toner for example may enter into such a fine scratch and readily adhere to the surface of the photosensitive member. The external additive has relatively low electric resistance. Therefore, a part of the surface of the photosensitive member to which the external additive adheres is hardly charged. As a result, black spots are generated on a formed image.

In order to inhibit black spot generation on a formed image, the Martens hardness of the photosensitive layer at 50° C. is preferably at least 180 N/mm$^2$, more preferably at least 185 N/mm$^2$, and further preferably at least 190 N/mm$^2$. No particular limitations are placed on an upper limit of the Martens hardness of the photosensitive layer at 50° C. so long as the photosensitive layer can function as a photosensitive layer of a photosensitive member. However, the upper limit of the Martens hardness of the photosensitive layer at 50° C. is preferably 250 N/mm$^2$ in view of manufacturing cost.

The Martens hardness of the photosensitive layer at 50° C. can be measured by a nanoindentation method in accordance with ISO 14577 standard. Specifically, the Martens hardness of the photosensitive layer at 50° C. is measured by a method described in association with Examples.

The Martens hardness of the photosensitive layer at 50° C. can be adjusted for example by changing a type of the hole transport material. It is thought that when the hole transport material has a structure that readily fills voids (gaps) in the binder resin, the photosensitive layer has a high density to increase the Martens hardness of the photosensitive layer at 50° C. The Martens hardness of the photosensitive layer at 50° C. can also be adjusted for example by changing a type of the binder resin. The Martens hardness of the photosensitive layer at 50° C. can also be adjusted for example by changing a content of the hole transport material relative to mass of the photosensitive layer. The Martens hardness of the photosensitive layer at 50° C. tends to increase with a decrease in content of the hole transport material relative to the mass of the photosensitive layer.

(Optical Response Time)

An optical response time of the photosensitive member is 0.05 milliseconds or longer and 0.85 milliseconds or shorter. The optical response time is a time from irradiation of the surface of the photosensitive layer charged to +800 V with pulse light having a wavelength of 780 nm to decay of a surface potential of the photosensitive layer from +800 V to +400 V. The pulse light has an intensity that allows the surface potential of the photosensitive layer to decay to +200 V from +800 V after 400 milliseconds elapse from the irradiation of the surface of the photosensitive layer charged to +800 V with the pulse light having a wavelength of 780 nm.

Figure 2:
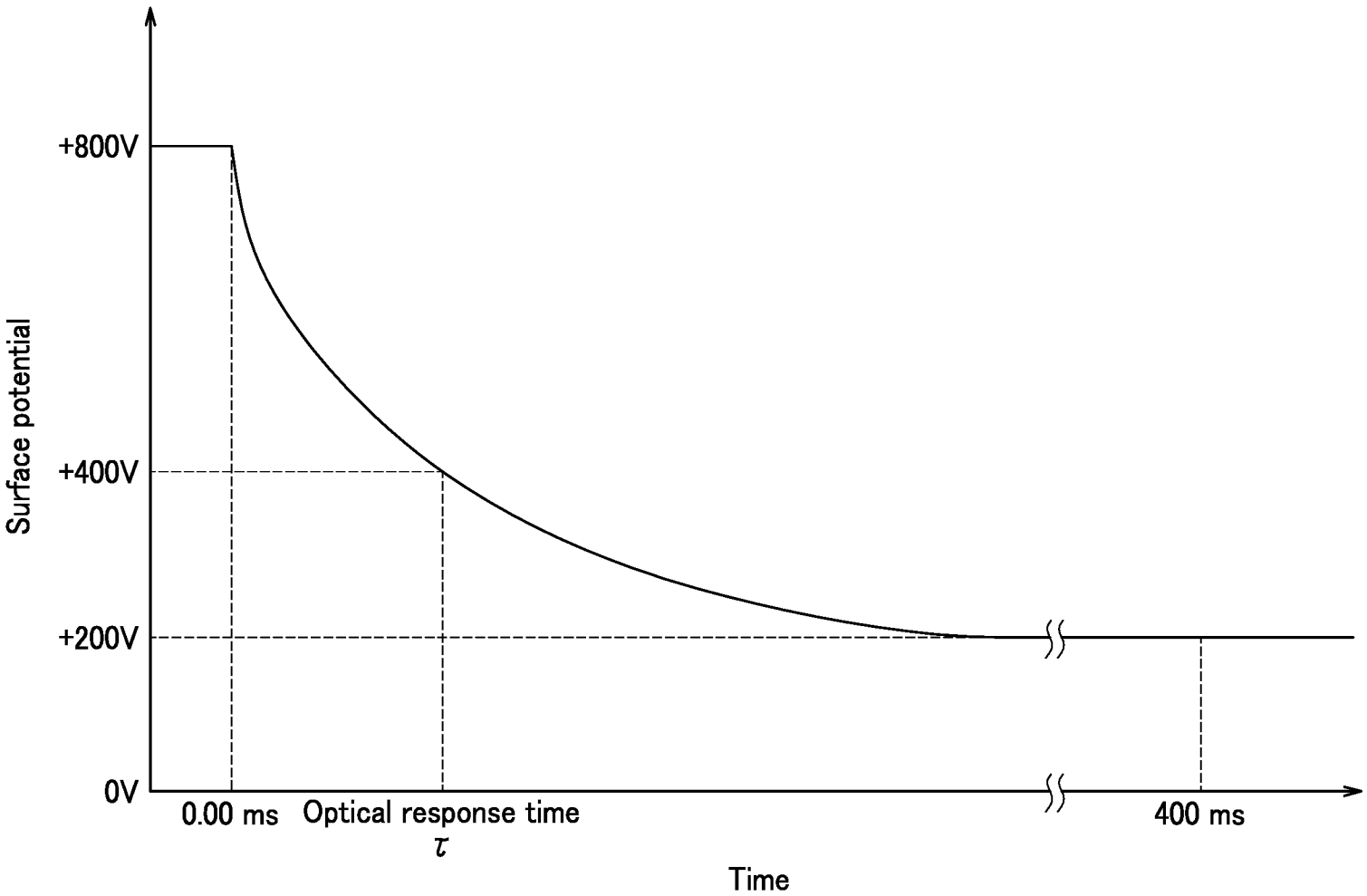
FIG. 2 is a graph representation showing a surface potential decay curve of a photosensitive layer.

The following describes the optical response time with reference to FIG. 2. FIG. 2 shows a surface potential decay curve of a photosensitive layer. A vertical axis indicates surface potential (unit: V) of the photosensitive layer. The horizontal axis indicates time. On the surface potential decay curve of the photosensitive layer, time when the surface of the photosensitive layer is irradiated with pulse light is taken to be 0.00 milliseconds. As shown by the surface potential decay curve of the photosensitive layer, the surface potential of the photosensitive layer decays from +800 V to +200 V after 400 milliseconds elapse from the irradiation of the surface of the photosensitive layer charged to +800 V with the pulse light. A time τ from the irradiation of the surface of the photosensitive layer charged to +800 V with the pulse light to decay of the surface potential of the photosensitive layer from +800 V to +400 V is taken to be the optical response time.

As a result of the optical response time of the photosensitive member being 0.05 milliseconds or longer and 0.85 milliseconds or shorter, production of an image defect resulting from exposure memory can be inhibited. The exposure memory herein is a phenomenon in which charge potential of an area of a surface of a photosensitive member corresponding to a region exposed to light in the previous rotation lowers relative to that of an area of the surface of the photosensitive member corresponding to a non-exposed region in the previous rotation under influence of light exposure in image formation. Upon occurrence of exposure memory, an image defect is produced by which an area of a formed image corresponding to the region of the photosensitive member exposed to light in the previous rotation is darkened. When the optical response time of the photosensitive member exceeds 0.85 milliseconds, charge (particularly, holes) tends to remain in the photosensitive layer. For the reason as above, an image defect resulting from exposure memory is produced. It takes some time for the photosensitive member to respond optically, and therefore, the optical response time of the photosensitive member may be determined to 0.05 milliseconds or longer.

In order to inhibit production of an image defect resulting from exposure memory, the upper limit of the optical response time of the photosensitive member is preferably 0.70 milliseconds, further preferably 0.60 milliseconds, and still further preferably 0.50 milliseconds. The lower limit of the optical response time of the photosensitive member may be for example 0.23 milliseconds.

The optical response time of the photosensitive member is measured by a method described in association with Examples. The optical response time of the photosensitive member can be adjusted for example by changing a type of the hole transport material. The optical response time of the photosensitive member can also be adjusted for example by changing a type of the electron transport material. The optical response time of the photosensitive layer can also be adjusted for example by changing a content of the hole transport material relative to the mass of the photosensitive layer. Alternatively or additionally, the optical response time of the photosensitive member can be adjusted for example by changing a ratio $m_{HTM}/m_{ETM}$ of mass $m_{HTM}$ of the hole transport material to mass $m_{ETM}$ of the electron transport material.

(Binder Resin)

Examples of the binder resin include thermoplastic resins, thermosetting resins, and photocurable resins. Examples of thermoplastic resins include polycarbonate resins, polyarylate resins, styrene-butadiene copolymers, styrene-acrylonitrile copolymers, styrene-maleate copolymers, acrylate polymers, styrene-acrylate copolymers, polyethylene resins, ethylene-vinyl acetate copolymers, chlorinated polyethylene resins, polyvinyl chloride resins, polypropylene resins, ionomer resins, vinyl chloride-vinyl acetate copolymers, alkyd resins, polyamide resins, urethane resins, polysulfone resins, diallyl phthalate resins, ketone resins, polyvinyl butyral resins, polyester resins, and polyether resins. Examples of thermosetting resins include silicone resins, epoxy resins, phenolic resins, urea resins, and melamine resins. Examples of photocurable resins include acrylic acid adducts of epoxy compounds and acrylic acid adducts of urethane compounds. One binder resin may be used independently, or two or more binder resins may be used in combination.

The binder resin is preferably a polycarbonate resin including a repeating unit represented by general formula (1) (also referred to below as a polycarbonate resin (1)). As a result of the photosensitive layer containing the polycarbonate resin (1) as the binder resin, black spot generation on a formed image can be inhibited.

(1)

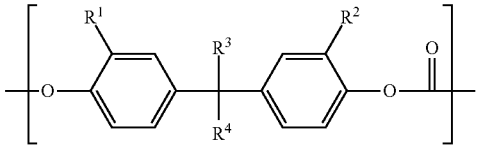

In general formula (1), $R^1$, $R^2$, $R^3$, and $R^4$ each represent, independently of one another, a hydrogen atom, an alkyl group having a carbon number of at least 1 and no greater than 3 and optionally having a halogen atom, or an aryl group having a carbon number of at least 6 and no greater than 14. $R^3$ and $R^4$ may be bonded together to represent a cycloalkylidene group having a carbon number of at least 5 and no greater than 7.

In general formula (1), an alkyl group having a carbon number of at least 1 and no greater than 3 that may be represented by $R^1$, $R^2$, $R^3$, or $R^4$ is preferably a methyl group or an ethyl group, and more preferably a methyl group. An alkyl group having a carbon number of at least 1 and no greater than 3 that may be represented by $R^1$, $R^2$, $R^3$, or $R^4$ may optionally have a halogen atom. A halogen atom that an alkyl group having a carbon number of at least 1 and no greater than 3 optionally has is preferably a fluorine atom or a chlorine atom, and more preferably a fluorine atom. The number of halogen atoms that an alkyl group having a carbon number of at least 1 and no greater than 3 may have is preferably at least 1 and no greater than 7, more preferably at least 1 and no greater than 5, and further preferably at least 1 and no greater than 3.

In general formula (1), an aryl group having a carbon number of at least 6 and no greater than 14 that may be represented by $R^1$, $R^2$, $R^3$, or $R^4$ is preferably an aryl group having a carbon number of at least 6 and no greater than 10, and more preferably a phenyl group.

In general formula (1), preferably, a cycloalkylidene group having a carbon number of at least 5 and no greater than 7 that is represented by $R^3$ and $R^4$ bonded together is a cyclohexylidene group.

In general formula (1), preferably, $R^1$ and $R^2$ each represent, independently of one another, a hydrogen atom or an alkyl group having a carbon number of at least 1 and no greater than 3 and optionally having a halogen atom. Preferably, $R^3$, and $R^4$ each represent, independently of one another, an alkyl group having a carbon number of at least 1 and no greater than 3, or are bonded together to represent a cycloalkylidene group having a carbon number of at least 5 and no greater than 7.

Preferable examples of the polycarbonate rein (1) include a polycarbonate resin including a repeating unit represented by chemical formula (R1), a polycarbonate resin including a repeating unit represented by chemical formula (R2), a polycarbonate resin including a repeating unit represented by chemical formula (R3), and a polycarbonate resin including a repeating unit represented by chemical formula (R4) (also referred to below as polycarbonate resins (R1), (R2), (R3), and (R4), respectively).

(R1)

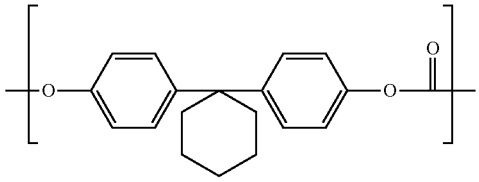

(R2)

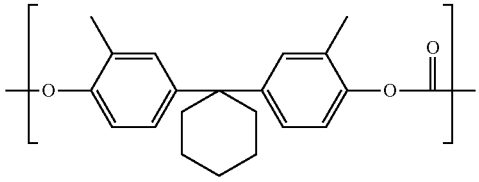

(R3)

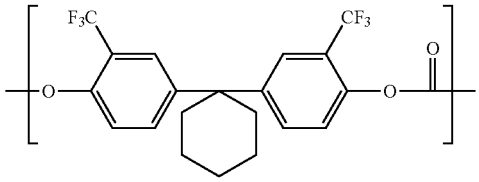

(R4)

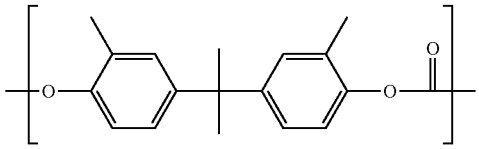

In order to increase the Martens hardness of the photosensitive layer at 50° C., the polycarbonate resins (R2), (R3), or (R4) is preferable as the polycarbonate resin (1). In order to inhibit black spot generation on a formed image, the polycarbonate resin (R2) or (R3) is preferable as the polycarbonate resin (1). In order to shorten the optical response time of the photosensitive member, the polycarbonate resin (R1) is preferable as the polycarbonate resin (1). In order to inhibit an image defect resulting from exposure memory, the polycarbonate resin (R1) or (R2) is preferable as the polycarbonate resin (1).

The polycarbonate resin (1) preferably has a viscosity average molecular weight of at least 25,000 and no greater than 60,000, and more preferably has a viscosity average molecular weight of at least 35,000 and no greater than 53,000. As a result of the polycarbonate resin (1) having a viscosity average molecular weight of at least 25,000, the Martens hardness of the photosensitive layer at 50° C. tends to increase. As a result of the polycarbonate resin (1) having a viscosity average molecular weight of no greater than 60,000, the polycarbonate resin (1) readily dissolves in a solvent for photosensitive layer formation, enabling favorable formation of the photosensitive layer.

The polycarbonate resin (1) may include the repeating unit represented by general formula (1) only as a repeating unit. Alternatively, the polycarbonate resin (1) may include a repeating unit other than the repeating unit represented by general formula (1) as a repeating unit in addition to the repeating unit represented by general formula (1). A ratio of the number of repeating units represented by general formula (1) relative to a total number of repeating units included in the polycarbonate resin (1) is preferably at least 0.80, more preferably at least 0.90, and particularly preferably 1.00.

The photosensitive layer may contain only one type of the polycarbonate resin (1) as the binder resin. Alternatively, the photosensitive layer may contain two or more types of the polycarbonate resin (1) as the binder resin. The photosensitive layer may further contain a binder resin other than the polycarbonate resin (1) as the binder resin in addition to the polycarbonate resin (1).

(Hole Transport Material)

Examples of the hole transport material include triphenylamine derivatives, diamine derivatives (for example, N,N,N',N'-tetraphenylbenzidine derivative, N,N,N',N'-tetraphenylphenylenediamine derivative, N,N,N',N'-tetraphenylnaphtylenediamine derivative, N,N,N',N'-tetraphenylphenanthrylenediamine derivative, and di(aminophenylethenyl)benzene derivative), oxadiazole-based compounds (for example, 2,5-di(4-methylaminophenyl)-1,3,4-oxadiazole), styryl-based compounds (for example, 9-(4-diethylaminostyryl)anthracene), carbazole-based compounds (for example, polyvinyl carbazole), organic polysilane compounds, pyrazoline-based compounds (for example, 1-phenyl-3-(p-dimethylaminophenyl) pyrazoline), hydrazone-based compounds, indole-based compounds, oxazole-based compounds, isoxazole-based compounds, thiazole-based compounds, thiadiazole-based compounds, imidazole-based compounds, pyrazole-based compounds, and triazole-based compounds. The photosensitive layer may contain only one hole transport material or two or more hole transport materials.

In order to inhibit black spot generation on a formed image and an image defect resulting from exposure memory, the hole transport material preferably includes at least one of compounds represented by general formulas (11) to (19). In the following, the compounds represented by general formulas (11) to (19) may be referred to as compounds (11) to (19), respectively.

The following describes the compound (11). In general formula (11) shown below, $Q^1$, $Q^2$, $Q^3$, and $Q^4$ each represent, independently of one another, an alkyl group having a carbon number of at least 1 and no greater than 6. $b_1$, $b_2$, $b_3$, and $b_4$ each represent, independently of one another, an integer of at least 0 and no greater than 5. $b_5$ represents 0 or 1.

(11)

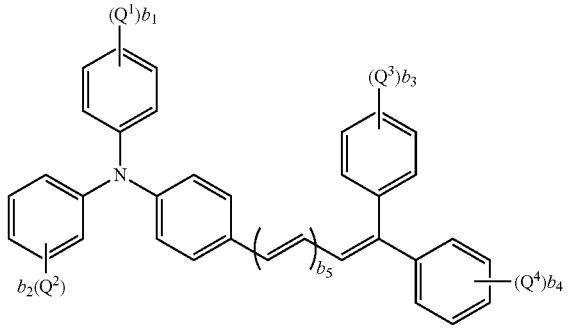

When $b_1$ represents an integer of at least 2 and no greater than 5, plural chemical groups $Q^1$ may be the same as or different from one another. When $b_2$ represents an integer of at least 2 and no greater than 5, plural chemical groups $Q^2$ may be the same as or different from one another. When $b_3$ represents an integer of at least 2 and no greater than 5, plural chemical groups $Q_3$ may be the same as or different from one another. When $b_4$ represents an integer of at least 2 and no greater than 5, plural chemical groups $Q^4$ may be the same as or different from one another.

In general formula (11), an alkyl group having a carbon number of at least 1 and no greater than 6 that may be represented by $Q^1$, $Q^2$, $Q^3$, or $Q^4$ is preferably an alkyl group having a carbon number of at least 1 and no greater than 3, and more preferably a methyl group.

In general formula (11), preferably, $Q^1$, $Q^2$, $Q^3$, and $Q^4$ each represent, independently of one another, an alkyl group having a carbon number of at least 1 and no greater than 3. Preferably, $b_1$, $b_2$, $b_3$, and $b_4$ each represent, independently of one another, 0 or 1. Preferably, $b_5$ represents 0 or 1.

Compounds represented by chemical formulas (11-HT1) and (11-HT2) (also referred to below as compounds (11-HT1) and (11-HT2), respectively) are each preferable as the compound (11).

(11-HT1)

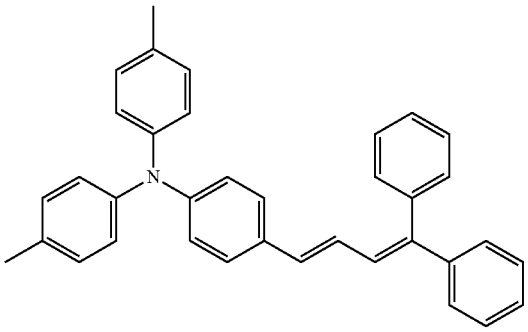

(11-HT2)

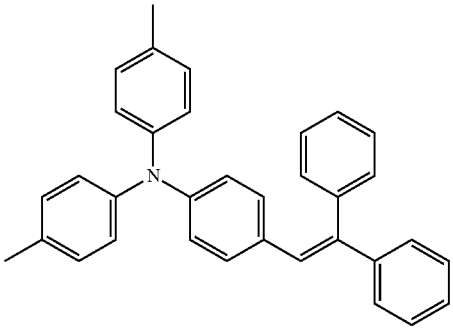

The following describes the compound (12). In general formula (12) shown below, $Q^{21}$ and $Q^{28}$ each represent, independently of one another, a hydrogen atom, a phenyl group optionally having an alkyl group having a carbon number of at least 1 and no greater than 6, an alkyl group having a carbon number of at least 1 and no greater than 6, or an alkoxy group having a carbon number of at least 1 and no greater than 6. $Q^{22}$ and $Q^{29}$ each represent, independently of one another, a phenyl group, an alkyl group having a carbon number of at least 1 and no greater than 6, or an alkoxy group having a carbon number of at least 1 and no greater than 6. $Q^{23}$, $Q^{24}$, $Q^{25}$, $Q^{26}$, and $Q^{27}$ each represent, independently of one another, a hydrogen atom, a phenyl group, an alkyl group having a carbon number of at least 1 and no greater than 6, or an alkoxy group having a carbon number of at least 1 and no greater than 6. Adjacent two of $Q^{23}$, $Q^{24}$, $Q^{25}$, $Q^{26}$, and $Q^{27}$ may be bonded together to form a ring (for example, a cycloalkane having a carbon number of at least 5 and no greater than 7, more specifically, cyclopentane, cyclohexane, or cycloheptane). $d_1$ and $d_2$ each represent, independently of one another, an integer of at least 0 and no greater than 2. $d_3$ and $d_4$ each represent, independently of one another, an integer of at least 0 and no greater than 5.

(12)

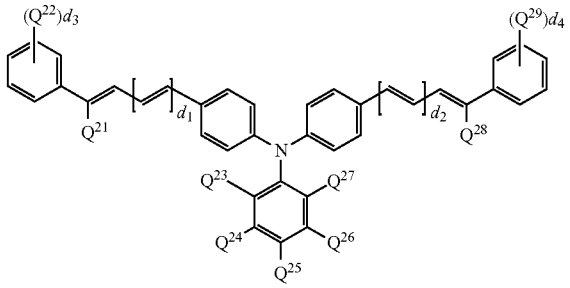

When $d_3$ represents an integer of at least 2 and no greater than 5, plural chemical groups $Q^{22}$ may be the same as or different from one another. When $d_4$ represents an integer of at least 2 and no greater than 5, plural chemical groups $Q^{29}$ may be the same as or different from one another.

In general formula (12), preferably, $Q^{21}$ and $Q^{28}$ each represent, independently of one another, a phenyl group optionally having an alkyl group having a carbon number of at least 1 and no greater than 6. Preferably, $Q^{22}$ and $Q^{29}$ each represent, independently of one another, an alkyl group having a carbon number of at least 1 and no greater than 6. Preferably, $Q^{23}$, $Q^{24}$, $Q^{25}$, $Q^{26}$, and $Q^{27}$ each represent, independently of one another, a hydrogen atom or an alkyl group having a carbon number of at least 1 and no greater than 6. Preferably, $d_1$ and $d_2$ each represent 0. Preferably, $d_3$ and $d_4$ each represent, independently of one another, 0 or 1. A phenyl group optionally having an alkyl group having a carbon number of at least 1 and no greater than 6 that may be represented by $Q^{21}$ or $Q^{28}$ is preferably a phenyl group optionally having an alkyl group having a carbon number of at least 1 and no greater than 3, and more preferably a phenyl group optionally having a methyl group. An alkyl group having a carbon number of at least 1 and no greater than 6 that may be represented by $Q^{22}$ or $Q^{29}$ is preferably an alkyl group having a carbon number of at least 1 and no greater than 3, and more preferably a methyl group. An alkyl group having a carbon number of at least 1 and no greater than 6 that may be represented by $Q^{23}$, $Q^{24}$, $Q^{25}$, $Q^{26}$, or $Q^{27}$ is preferably an alkyl group having a carbon number of at least 1 and no greater than 4, and more preferably a methyl group, an ethyl group, or an n-butyl group, and further preferably a methyl group. $Q^{25}$ being a methyl group is particularly preferable. $Q^{23}$ and $Q^{27}$ each being a hydrogen atom is particularly preferable. $Q^{24}$ and $Q^{26}$ each being a hydrogen atom is particularly preferable.

In order to inhibit production of an image defect resulting from exposure memory, it is preferable in general formula (12) that: $Q^{21}$ and $Q^{28}$ are the same as each other; $Q^{22}$ and $Q^{29}$ are the same as each other; $d_1$ and $d_2$ represent the same integer as each other; and $d_3$ and $d_4$ represent the same integer as each other.

Compounds represented by chemical formulas (12-HT3) and (12-HT4) (also referred to below as compounds (12-HT3) and (12-HT4), respectively) are each preferable as the compound (12).

(12-HT3)

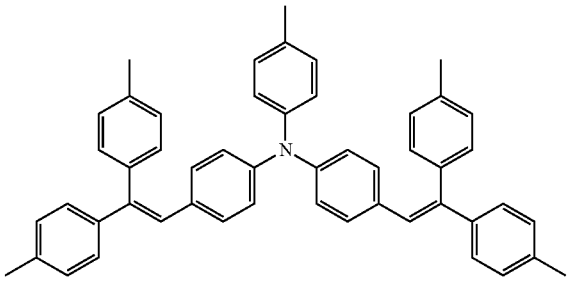

(12-HT4)

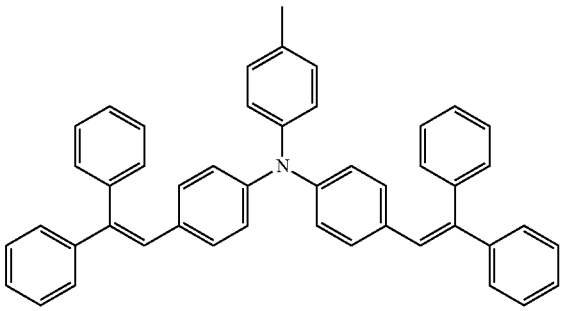

The following describes the compound (13). In general formula (13) shown below, $Q^{31}$, $Q^{32}$, $Q^{33}$, and $Q^{34}$ each represent, independently of one another, an alkyl group having a carbon number of at least 1 and no greater than 6 or an alkoxy group having a carbon number of at least 1 and no greater than 6. $e_1$, $e_2$, $e_3$, and $e_4$ each represent, independently of one another, an integer of at least 0 and no greater than 5. $e_5$ represents 2 or 3.

(13)

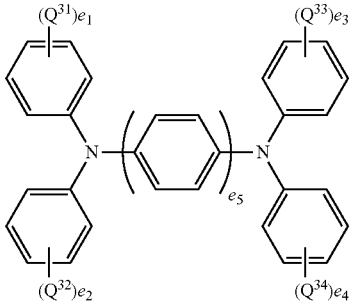

When $e_1$ represents an integer of at least 2 and no greater than 5, plural chemical groups $Q^{31}$ may be the same as or different from one another. When $e_2$ represents an integer of at least 2 and no greater than 5, plural chemical groups $Q^{32}$ may be the same as or different from one another. When $e_3$ represents an integer of at least 2 and no greater than 5, plural chemical groups $Q^{33}$ may be the same as or different from one another. When $e_4$ represents an integer of at least 2 and no greater than 5, plural chemical groups $Q^{34}$ may be the same as or different from one another.

In general formula (13), preferably, $Q^{31}$, $Q^{32}$, $Q^{33}$, and $Q^{34}$ each represent, independently of one another, an alkyl group having a carbon number of at least 1 and no greater than 6. An alkyl group having a carbon number of at least 1 and no greater than 6 that may be represented by $Q^{31}$, $Q^{32}$, $Q^{33}$, or $Q^{34}$ is preferably an alkyl group having a carbon number of at least 1 and no greater than 3, and more preferably a methyl group. Preferably, $e_1$, $e_2$, $e_3$, and $e_4$ each represent, independently of one another, 0 or 1. Preferably, $e_5$ represents 2 or 3.

Compounds represented by chemical formulas (13-HT5) and (13-HT6) (also referred to below as compounds (13-HT5) and (13-HT6), respectively) are each preferable as the compound (13).

(13-HT5)

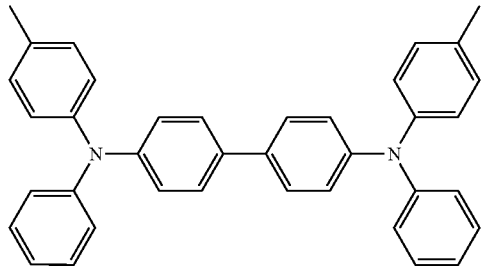

(13-HT6)

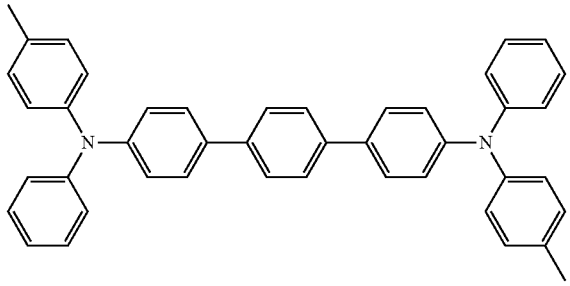

The following describes the compound (14). In general formula (14), $Q^{41}$, $Q^{42}$, $Q^{43}$, $Q^{44}$, $Q^{45}$, and $Q^{46}$ each represent, independently of one another, a hydrogen atom, a phenyl group, an alkyl group having a carbon number of at least 1 and no greater than 6, or an alkoxy group having a carbon number of at least 1 and no greater than 6. $Q^{47}$, $Q^{48}$, $Q^{49}$, and $Q^{50}$ each represent, independently of one another, a phenyl group, an alkyl group having a carbon number of at least 1 and no greater than 6, or an alkoxy group having a carbon number of at least 1 and no greater than 6. $g_1$ and $g_2$ each represent, independently of one another, an integer of at least 0 and no greater than 5. $g_3$ and $g_4$ each represent, independently of one another, an integer of at least 0 and no greater than 4. f represents 0 or 1.

(14)

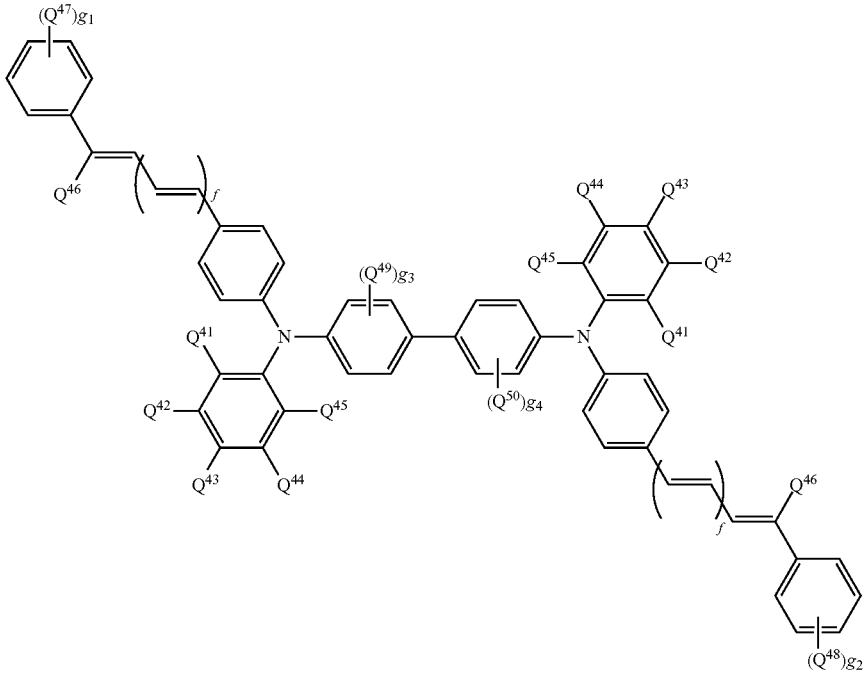

When $g_1$ represents an integer of at least 2 and no greater than 5, plural chemical groups $Q^{47}$ may be the same as or different from one another. When $g_2$ represents an integer of at least 2 and no greater than 5, plural chemical groups $Q^{48}$ may be the same as or different from one another. When $g_3$ represents an integer of at least 2 and no greater than 4, plural chemical groups $Q^{49}$ may be the same as or different from one another. When $g_4$ represents an integer of at least 2 and no greater than 4, plural chemical groups $Q^{50}$ may be the same as or different from one another.

In general formula (14), preferably, $Q^{41}$, $Q^{42}$, $Q^{43}$, $Q^{44}$, $Q^{45}$, and $Q^{46}$ each represent, independently of one another, a hydrogen atom or an alkyl group having a carbon number of at least 1 and no greater than 6. Preferably, $g_1$ and $g_2$ each represent 0. Preferably, $g_3$ and $g_4$ each represent 0. Preferably, f represents 0. An alkyl group having a carbon number of at least 1 and no greater than 6 that may be represented by $Q^{41}$, $Q^{42}$, $Q^{43}$, $Q^{44}$, $Q^{45}$, or $Q^{46}$ is preferably an alkyl group having a carbon number of at least 1 and no greater than 3, and more preferably a methyl group or an ethyl group.

The compound (14) is preferably a compound represented by chemical formula (14-HT7) (also referred to below as compound (14-HT7)).

(14-HT7)

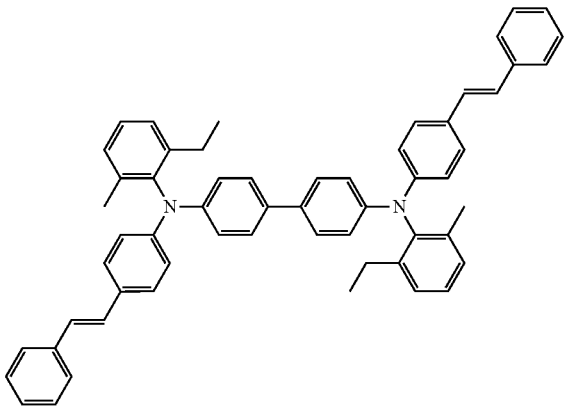

The following describes the compound (15). In general formula (15) shown below, $Q^{51}$, $Q^{52}$, $Q^{53}$, $Q^{54}$, $Q^{55}$, and $Q^{56}$ each represent, independently of one another, a phenyl group, an alkenyl group having a carbon number of at least 2 and no greater than 4 and optionally having one or more phenyl groups, an alkyl group having a carbon number of at least 1 and no greater than 6, or an alkoxy group having a carbon number of at least 1 and no greater than 6. $h_3$ and $h_6$ each represent, independently of one another, an integer of at least 0 and no greater than 4. $h_1$, $h_2$, $h_4$, and $h_5$ each represent, independently of one another, an integer of at least 0 and no greater than 5.

(15)

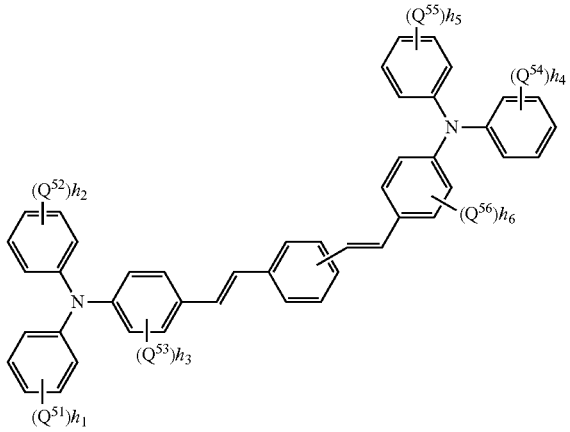

When $h_3$ represents an integer of at least 2 and no greater than 4, plural chemical groups $Q^{53}$ may be the same as or different from one another. When $h_6$ represents an integer of at least 2 and no greater than 4, plural chemical groups $Q^{56}$ may be the same as or different from one another. When $h_1$ represents an integer of at least 2 and no greater than 5, plural chemical groups $Q^{51}$ may be the same as or different from one another. When $h_2$ represents an integer of at least 2 and no greater than 5, plural chemical groups $Q^{52}$ may be the same as or different from one another. When $h_4$ represents an integer of at least 2 and no greater than 5, plural chemical groups $Q^{54}$ may be the same as or different from one another. When $h_5$ represents an integer of at least 2 and no greater than 5, plural chemical groups $Q^{55}$ may be the same as or different from one another.

In general formula (15), preferably, $Q^{51}$, $Q^{52}$, $Q^{53}$, $Q^{54}$, $Q^{55}$, and $Q^{56}$ each represent, independently of one another, an alkyl group having a carbon number of at least 1 and no greater than 6 or an alkenyl group having a carbon number of at least 2 and no greater than 4 and optionally having one or more phenyl groups. Preferably, $h_3$ and $h_6$ each represent 0. Preferably, $h_1$, $h_2$, $h_4$, and $h_5$ each represent, independently of one another, an integer of at least 0 and no greater than 2. An alkenyl group having a carbon number of at least 2 and no greater than 4 and optionally having one or more phenyl groups that may be represented by $Q^{51}$, $Q^{52}$, $Q^{53}$, $Q^{54}$, $Q^{55}$, or $Q^{56}$ is preferably an ethenyl group having at least 1 and no greater than 3 phenyl groups, and more preferably a diphenylethenyl group. An alkyl group having a carbon number of at least 1 and no greater than 6 that may be represented by $Q^{51}$, $Q^{52}$, $Q^{53}$, $Q^{54}$, $Q^{55}$, or $Q^{56}$ is preferably an alkyl group having a carbon number of at least 1 and no greater than 3, and more preferably a methyl group or an ethyl group.

Compounds represented by chemical formulas (15-HT8), (15-HT9), and (15-HT10) (also referred to below as compounds (15-HT8), (15-HT9), and (15-HT10), respectively) are each preferable as the compound (15).

(15-HT8)

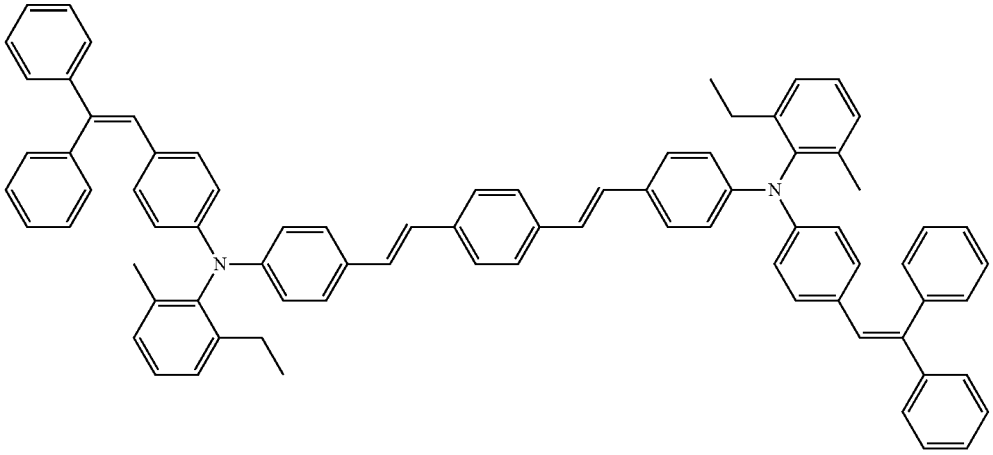

(15-HT9)

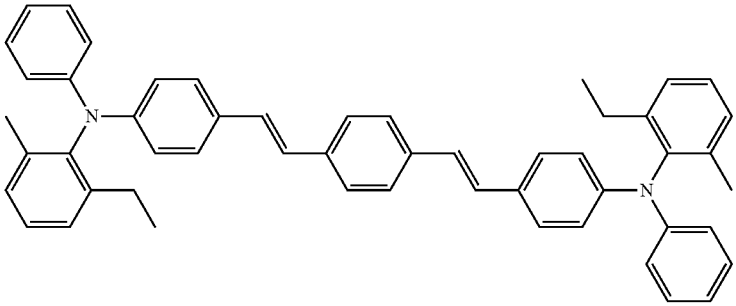

(15-HT10)

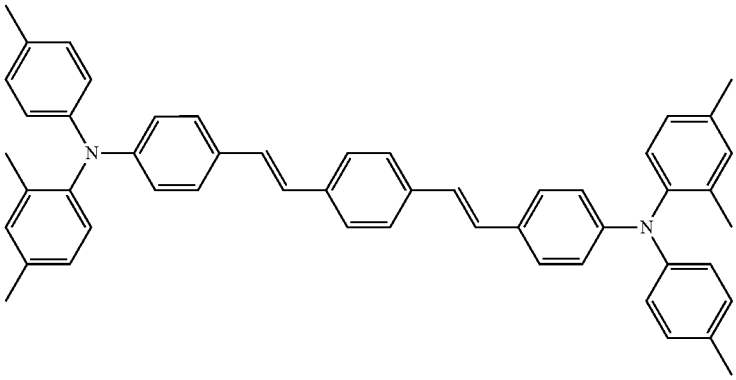

The following describes the compound (16). In general formula (16) shown below, $Q^{61}$, $Q^{62}$, $Q^{63}$, and $Q^{64}$ each represent, independently of one another, an alkyl group having a carbon number of at least 1 and no greater than 6. $j_1$, $j_2$, $j_3$, and $j_4$ each represent, independently of one another, an integer of at least 0 and no greater than 5.

(16)

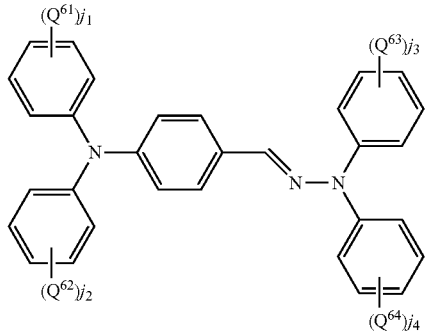

When $j_1$ represents an integer of at least 2 and no greater than 5, plural chemical groups $Q^{61}$ may be the same as or different from one another. When $j_2$ represents an integer of at least 2 and no greater than 5, plural chemical groups $Q^{62}$ may be the same as or different from one another. When $j_3$ represents an integer of at least 2 and no greater than 5, plural chemical groups $Q^{63}$ may be the same as or different from one another. When $j_4$ represents an integer of at least 2 and no greater than 5, plural chemical groups $Q^{64}$ may be the same as or different from one another.

In general formula (16), preferably, $Q^{61}$, $Q^{62}$, $Q^{63}$, and $Q^{64}$, each represent, independently of one another, an alkyl group having a carbon number of at least 1 and no greater than 3. Preferably, $j_1$, $j_2$, $j_3$, and $j_4$ each represent, independently of one another, 0 or 1. An alkyl group having a carbon number of at least 1 and no greater than 3 that may be represented by $Q^{61}$, $Q^{62}$, $Q^{63}$, or $Q^{64}$ is preferably a methyl group.

The compound (16) is preferably a compound represented by chemical formula (16-HT11) (also referred to below as compound (16-HT11)).

(16-HT11)

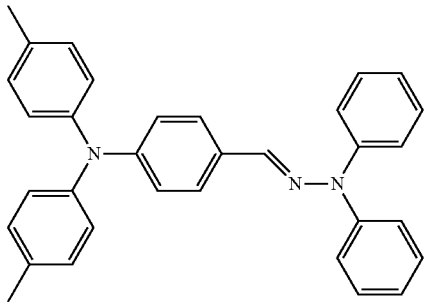

The following describes the compound (17). In general formula (17) shown below, $Q^{71}$, $Q^{72}$, $Q^{73}$, and $Q^{74}$ each represent, independently of one another, an alkyl group having a carbon number of at least 1 and no greater than 6. $k_1$, $k_2$, $k_3$, and $k_4$ each represent, independently of one another, an integer of at least 0 and no greater than 5.

(17)

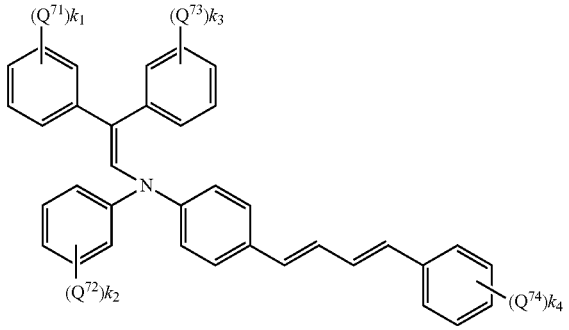

When $k_1$ represents an integer of at least 2 and no greater than 5, plural chemical groups $Q^{71}$ may be the same as or different from one another. When $k_2$ represents an integer of at least 2 and no greater than 5, plural chemical groups $Q^{72}$ may be the same as or different from one another. When $k_3$ represents an integer of at least 2 and no greater than 5, plural chemical groups $Q^{73}$ may be the same as or different from one another. When $k_4$ represents an integer of at least 2 and no greater than 5, plural chemical groups $Q^{74}$ may be the same as or different from one another.

In general formula (17), preferably, $Q^{71}$, $Q^{72}$, $Q^{73}$, and $Q^{74}$, each represent, independently of one another, an alkyl group having a carbon number of at least 1 and no greater than 3. Preferably, $k_1$, $k_2$, $k_3$, and $k_4$ each represent, independently of one another, 0 or 1. An alkyl group having a carbon number of at least 1 and no greater than 3 that may be represented by $Q^{71}$, $Q^{72}$, $Q^{73}$, or $Q^{74}$ is preferably a methyl group.

The compound (17) is preferably a compound represented by chemical formula (17-HT12) (also referred to below as compound (17-HT12)).

(17-HT12)

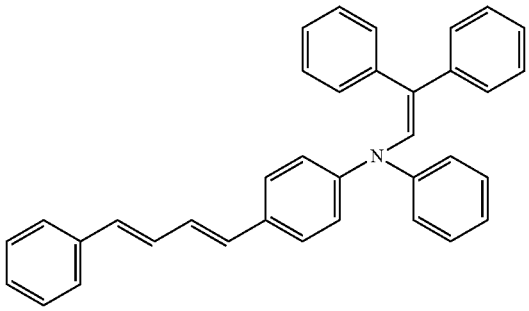

The following describes the compound (18). In general formula (18) shown below, $Q^{81}$, $Q^{82}$, $Q^{83}$, $Q^{84}$, $Q^{85}$, and $Q^{86}$ each represent, independently of one another, a halogen atom, an alkyl group having a carbon number of at least 1 and no greater than 6, an alkoxy group having a carbon number of at least 1 and no greater than 6, or an aryl group having a carbon number of at least 6 and no greater than 14. $n_1$, $n_2$, $n_3$, $n_4$, $n_5$, and $n_6$ each represent, independently of one another, an integer of at least 0 and no greater than 5. x represents an integer of at least 1 and no greater than 3. r and s each represent, independently of one another, 0 or 1.

(18)

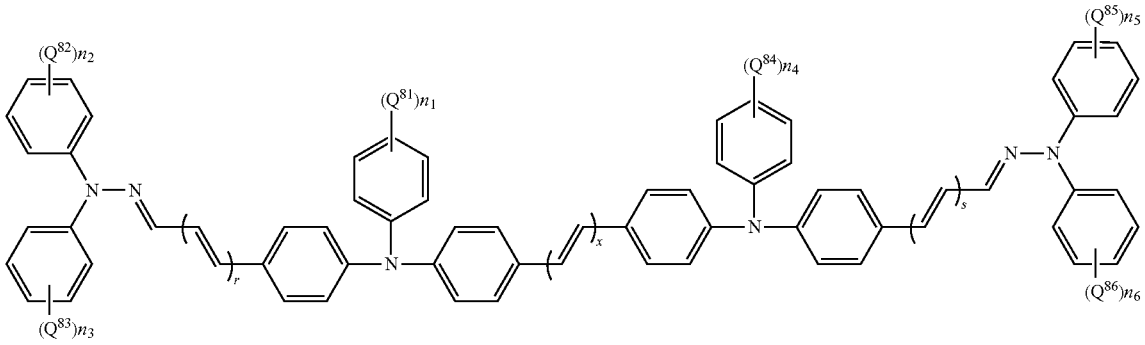

When $n_1$ represents an integer of at least 2 and no greater than 5, plural chemical groups $Q^{81}$ may be the same as or different from one another. When $n_2$ represents an integer of at least 2 and no greater than 5, plural chemical groups $Q^{82}$ may be the same as or different from one another. When $n_3$ represents an integer of at least 2 and no greater than 5, plural chemical groups $Q^{83}$ may be the same as or different from one another. When $n_4$ represents an integer of at least 2 and no greater than 5, plural chemical groups $Q^{84}$ may be the same as or different from one another. When $n_5$ represents an integer of at least 2 and no greater than 5, plural chemical groups $Q^{85}$ may be the same as or different from one another. When $n_6$ represents an integer of at least 2 and no greater than 5, plural chemical groups $Q^{86}$ may be the same as or different from one another.

In general formula (18), preferably, $Q^{81}$, $Q^{82}$, $Q^{83}$, $Q^{84}$, $Q^{85}$, and $Q^{86}$ each represent, independently of one another, an alkyl group having a carbon number of at least 1 and no greater than 6. Preferably, $n_1$, $n_2$, $n_3$, $n_4$, $n_5$, and $n_6$ each represent, independently of one another, 0 or 1. Preferably, x represents 2. Preferably, r and s each represent 0. An alkyl group having a carbon number of at least 1 and no greater than 6 that may be represented by $Q^{81}$, $Q^{82}$, $Q^{83}$, $Q^{84}$, $Q^{85}$, or $Q^{86}$ is preferably an alkyl group having a carbon number of at least 1 and no greater than 3, and more preferably a methyl group.

The compound (18) is preferably a compound represented by chemical formula (18-HT13) (also referred to below as compound (18-HT13)).

The following describes the compound (19). In general formula (19) shown below, $R^{91}$ and $R^{92}$ each represent, independently of one another, an alkyl group having a carbon number of at least 1 and no greater than 6, an alkoxy group having a carbon number of at least 1 and no greater than 6, an aryl group having a carbon number of at least 6 and no greater than 14, or an aralkyl group having a carbon number of at least 7 and no greater than 20. $p_1$ and $p_2$ each represent, independently of one another, an integer of at least 0 and no greater than 5. $p_3$ represents an integer of at least 0 and no greater than 2.

(19)

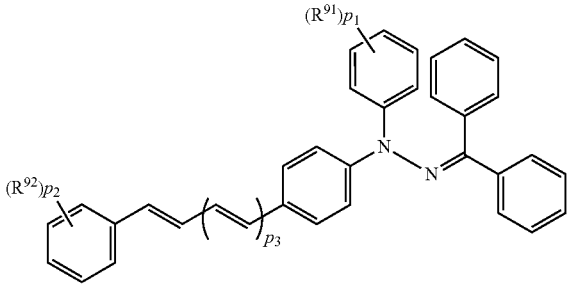

When $p_1$ represents an integer of at least 2, plural chemical groups $R^{91}$ may be the same as or different from one (18-HT13)

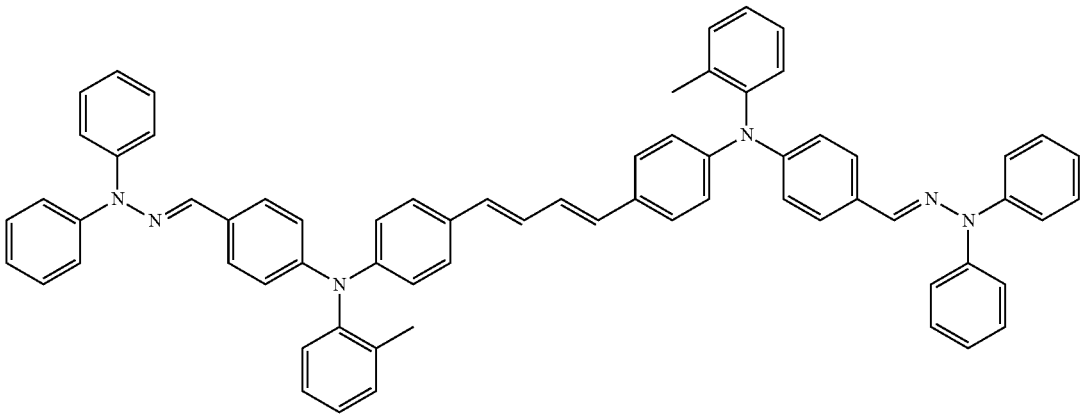

another. When $p_2$ represents an integer of at least 2, plural chemical groups $R^{92}$ may be the same as or different from one another.

In general formula (19), preferably, $R^{91}$ represents an alkyl group having a carbon number of at least 1 and no greater than 3 or an alkoxy group having a carbon number of at least 1 and no greater than 3. Preferably, $R^{92}$ represents an alkyl group having a carbon number of at least 1 and no greater than 3. Preferably, $p_1$ represents an integer of at least 0 and no greater than 2, and more preferably represents 0. Preferably, $p_2$ represents 0 or 1, and more preferably represents 0. Preferably, $p_3$ represents 1 or 2.

The compound (19) is preferably a compound represented by chemical formula (19-HT17) (also referred to below as compound (19-HT17)).

(19-HT17)

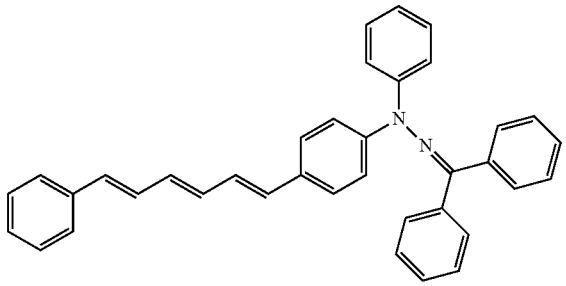

The photosensitive layer may contain only one of the compounds (11) to (19) as the hole transport material. In order to particularly inhibit black spot generation on a formed image and an image defect resulting from exposure memory, the photosensitive layer preferably contains at least two of the compounds (11) to (19) as the hole transport material, more preferably contains two of the compounds (11) to (19), and further preferably contains the compound (11) and the compound (12). The photosensitive layer may further contain a hole transport material other than the compounds (11) to (19) in addition to any of the compounds (11) to (19).

In order to particularly inhibit black spot generation on a formed image and an image defect resulting from exposure memory, the photosensitive layer preferably contains at least one of the compounds (11-HT1), (11-HT2), (12-HT3), (12-HT4), (13-HT5), (13-HT6), (14-HT7), (15-HT8), (15-HT9), (15-HT10), (16-HT11), (17-HT12), (18-HT13), and (19-HT17) as the hole transport material. The photosensitive layer may contain only one of the compounds (11-HT1), (11-HT2), (12-HT3), (12-HT4), (13-HT5), (13-HT6), (14-HT7), (15-HT8), (15-HT9), (15-HT10), (16-HT11), (17-HT12), (18-HT13), and (19-HT17) as the hole transport material. In order to particularly inhibit black spot generation on a formed image and an image defect resulting from exposure memory, the photosensitive layer preferably contains at least two of the compounds (11-HT1), (11-HT2), (12-HT3), (12-HT4), (13-HT5), (13-HT6), (14-HT7), (15-HT8), (15-HT9), (15-HT10), (16-HT11), (17-HT12), (18-HT13), and (19-HT17) as the hole transport material, more preferably contains two of these compounds, and further preferably contains the compound (11-HT1) and the compounds (12-HT3).

In order to particularly inhibit an image defect resulting from exposure memory, the compound (11), (12), (14), (15), (17), (18), or (19) is preferable as the hole transport material, and the compound (11), (12), (14), (15), (18), or (19) is more preferable. In order to particularly inhibit an image defect resulting from exposure memory, the compound (11-HT1), (11-HT2), (12-HT3), (12-HT4), (14-HT7), (15-HT8), (15-HT9), (15-HT10), (17-HT12), (18-HT13), or (19-HT17) is preferable as the hole transport material, and the compound (11-HT1), (11-HT2), (12-HT3), (12-HT4), (14-HT7), (15-HT8), (18-HT13), or (19-HT17) is more preferable.

In order to particularly inhibit black spot generation on a formed image, the compound (11), (12), (13), (14), (15), or (18) is preferable as the hole transport material, and the compound (13) is more preferable. In order to particularly inhibit black spot generation on a formed image, the compound (11-HT1), (12-HT3), (12-HT4), (13-HT5), (13-HT6), (14-HT7), (15-HT8), (15-HT9), or (18-HT13) is preferable as the hole transport material, and the compound (13-HT5) or (13-HT6) is more preferable.

In order to achieve well-balanced inhibition of black spot generation on a formed image and an image defect resulting from exposure memory, the compound (19) is preferable as the hole transport material and the compound (19-HT17) is more preferable.

The content of the hole transport material is preferably at least 35% by mass and no greater than 65% by mass relative to the mass of the photosensitive layer, more preferably at least 38% by mass and no greater than 60% by mass, and further preferably at least 38% by mass and no greater than 55% by mass. When the content of the hole transport material is at least 35% by mass relative to the mass of the photosensitive layer, an image defect resulting from exposure memory can be favorably inhibited. By contrast, when the content of the hole transport material is no greater than 65% by mass relative to the mass of the photosensitive layer, black spot generation on a formed image can be favorably inhibited. Furthermore, it is thought that the photosensitive layer is hardly crystallized when the content of the hole transport material is no greater than 65% by mass relative to the mass of the photosensitive layer.

The ratio $m_{HTM}/m_{ETM}$ of the mass $m_{HTM}$ of the hole transport material to the mass $m_{ETM}$ of the electron transport material is preferably at least 1.2 and no greater than 4.0, and more preferably at least 1.5 and no greater than 3.0. When the ratio $m_{HTM}/m_{ETM}$ is at least 1.2, an image defect resulting from exposure memory can be favorably inhibited. By contrast, when the ratio $m_{HTM}/m_{ETM}$ is no greater than 4.0, black spot generation on a formed image can be favorable inhibited. In a case where the photosensitive layer contains two or more electron transport materials, the mass $m_{ETM}$ of the electron transport material is total mass of the two or more electron transport materials. In a case where the photosensitive layer contains two or more hole transport materials, the mass $m_{HTM}$ of the hole transport material is total mass of the two or more hole transport materials.

The amount of the hole transport material contained in the photosensitive layer is preferably at least 10 parts by mass and no greater than 300 parts by mass relative to 100 parts by mass of the binder resin, and more preferably at least 60 parts by mass and no greater than 250 parts by mass.

(Electron Transport Material)

Examples of the electron transport material include quinone-based compounds, diimide-based compounds, hydrazone-based compounds, malononitrile-based compounds, thiopyran-based compounds, trinitrothioxanthone-based compounds, 3,4,5,7-tetranitro-9-fluorenone-based compounds, dinitroanthracene-based compounds, dinitroacridine-based compounds, tetracyanoethylene, 2,4,8-trinitrothioxanthone, dinitrobenzene, dinitroacridine, succinic anhydride, maleic anhydride, and dibromomaleic anhydride. Examples of quinone-based compounds include dipheno-quinone-based compounds, azoquinone-based compounds, anthraquinone-based compounds, naphthoquinone-based compounds, nitroanthraquinone-based compounds, and dinitroanthraquinone-based compounds. Any one of the electron transport materials listed above may be used independently, or any two or more of the electron transport materials listed above may be used in combination.

Favorable electron transport materials among the electron transport materials listed above are compounds represented by general formulas (21), (22), and (23) (also referred to below as compounds (21), (22), and (23), respectively).

(21)

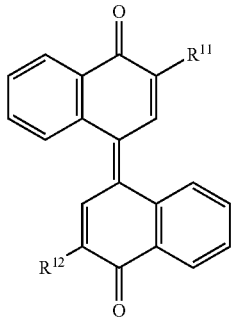

(22)

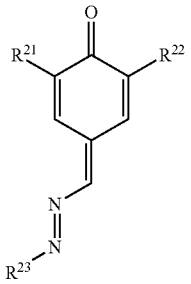

(23)

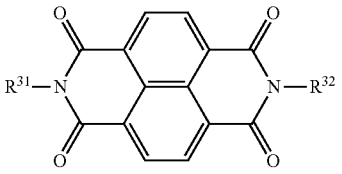

In general formula (21), $R^{11}$ and $R^{12}$ each represent, independently of one another, an alkyl group having a carbon number of at least 1 and no greater than 6, an alkoxy group having a carbon number of at least 1 and no greater than 6, an aryl group having a carbon number of at least 6 and no greater than 14, or an aralkyl group having a carbon number of at least 7 and no greater than 20.

In general formula (21), preferably, $R^{11}$ and $R^{12}$ each represent, independently of one another, an alkyl group having a carbon number of at least 1 and no greater than 6. An alkyl group having a carbon number of at least 1 and no greater than 6 that may be represented by $R^{11}$ or $R^{12}$ in general formula (21) is preferably an alkyl group having a carbon number of at least 1 and no greater than 5, and more preferably 1,1-dimethylpropyl group.

The compound (21) is preferably a compound represented by chemical formula (ET1) (also referred to below as compound (ET1)).

(ET1)

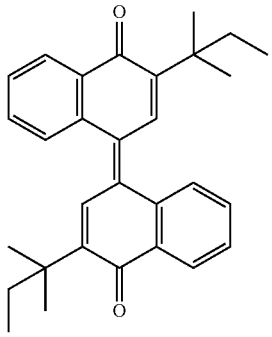

In general formula (22), $R^{21}$, $R^{22}$, and $R^{23}$ each represent, independently of one another, a halogen atom, an alkyl group having a carbon number of at least 1 and no greater than 6, an alkoxy group having a carbon number of at least 1 and no greater than 6, an aryl group having a carbon number of at least 6 and no greater than 14 and optionally having a halogen atom, an aralkyl group having a carbon number of at least 7 and no greater than 20, or a heterocyclic group having at least 5 members and no greater than 14 members.

In general formula (22), it is preferable that $R^{21}$ and $R^{22}$ each represent, independently of one another, an alkyl group having a carbon number of at least 1 and no greater than 6 and $R^{23}$ represents an aryl group having a carbon number of at least 6 and no greater than 14 and optionally having a halogen atom. An alkyl group having a carbon number of at least 1 and no greater than 6 that may be represented by $R^{21}$ or $R^{22}$ is preferably an alkyl group having a carbon number of at least 1 and no greater than 4, and more preferably a tert-butyl group. An aryl group having a carbon number of at least 6 and no greater than 14 that may be represented by $R^{23}$ is preferably an aryl group having a carbon number of at least 6 and no greater than 10, and more preferably a phenyl group. An aryl group having a carbon number of at least 6 and no greater than 14 that may be represented by $R^{23}$ may optionally have a halogen atom. A halogen atom such as above is preferably a fluorine atom or a chlorine atom, and more preferably a chlorine atom. An aryl group having a carbon number of at least 6 and no greater than 14 that may be represented by $R^{23}$ preferably has at least 1 and no greater than 3 halogen atoms, and more preferably 1 halogen atom.

The compound (22) is preferably a compound represented by chemical formula (ET2) (also referred to below as compound (ET2)).

(ET2)

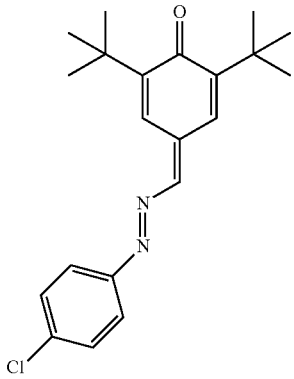

In general formula (23), $R^{31}$ and $R^{32}$ each represent, independently of one another, a halogen atom, an amino group, an alkyl group having a carbon number of at least 1 and no greater than 6, an alkoxy group having a carbon number of at least 1 and no greater than 6, or an aryl group having a carbon number of at least 6 and no greater than 14 and optionally having a substituent group.

In general formula (23), preferably, $R^{31}$ and $R^{32}$ each represent, independently of one another, an aryl group having a carbon number of at least 6 and no greater than 14 and optionally having a substituent. An aryl group having a carbon number of at least 6 and no greater than 14 that may be represented by $R^{31}$ or $R^{32}$ is preferably an aryl group having a carbon number of at least 6 and no greater than 10, and more preferably a phenyl group. An aryl group having a carbon number of at least 6 and no greater than 14 that may be represented by $R^{31}$ or $R^{32}$ may optionally have a substituent. Examples of a substituent such as above include a halogen atom, a hydroxyl group, a nitro group, a cyano group, an alkyl group having a carbon number of at least 1 and no greater than 6, an alkoxy group having a carbon number of at least 1 and no greater than 6, and an aryl group having a carbon number of least 6 and no greater than 14. A substituent of an aryl group having a carbon number of at least 6 and no greater than 14 that may be represented by $R^{31}$ or $R^{32}$ is preferably an alkyl group having a carbon number of at least 1 and no greater than 6, more preferably an alkyl group having a carbon number of at least 1 and no greater than 3, and further preferably a methyl group or an ethyl group. An aryl group having a carbon number of at least 6 and no greater than 14 that may be represented by $R^{31}$ or $R^{32}$ preferably has at least 1 and no greater than 3 substituents, more preferably has at least 1 and no greater than 2 substituents, and further preferably has 2 substituents.

The compound (23) is preferably a compound represented by chemical formula (ET3) (also referred to below as compound (ET3)).

(ET3)

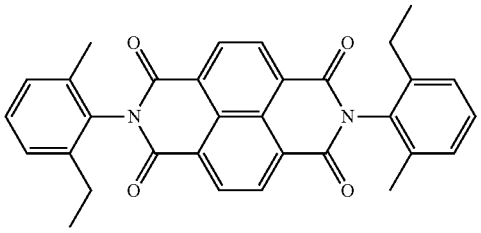

The photosensitive layer may contain only one of the compounds (21), (22), and (23) as the electron transport material. Alternatively, the photosensitive layer may contain two or more of the compounds (21), (22), and (23) as the electron transport material. The photosensitive layer may further contain, as the electron transport material, an electron transport material other than the compounds (21), (22), and (23) in addition to any of the compounds (21), (22), and (23).

In order to inhibit black spot generation on a formed image and an image defect resulting from exposure memory, the amount of the electron transport material is preferably at least 20 parts by mass and no greater than 200 parts by mass relative to 100 parts by mass of the binder resin, and more preferably at least 40 parts by mass and no greater than 150 parts by mass.

(Charge Generating Material)

No particular limitations are placed on the charge generating material other than being a charge generating material that can be used in a photosensitive member. Examples of the charge generating material include phthalocyanine-based pigments, perylene-based pigments, bisazo pigments, tris-azo pigments, dithioketopyrrolopyrrole pigments, metal-free naphthalocyanine pigments, metal naphthalocyanine pigments, squaraine pigments, indigo pigments, azulenium pigments, cyanine pigments, powders of inorganic photoconductive materials (for example, selenium, selenium-tellurium, selenium-arsenic, cadmium sulfide, and amorphous silicon), pyrylium pigments, anthanthrone-based pigments, triphenylmethane-based pigments, threne-based pigments, toluidine-based pigments, pyrazoline-based pigments, and quinacridon-based pigments. One charge generating material may be used independently, or two or more charge generating materials may be used in combination.

Examples of phthalocyanine-based pigments include metal-free phthalocyanine and metal phthalocyanine. Examples of metal phthalocyanine include titanyl phthalocyanine, hydroxygallium phthalocyanine, and chlorogallium phthalocyanine. Titanyl phthalocyanine is for example represented by chemical formula (CG1). Metal-free phthalocyanine is for example represented by chemical formula (CG2).

(CG1)

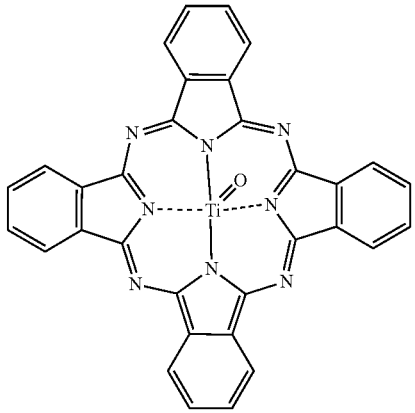

(CG2)

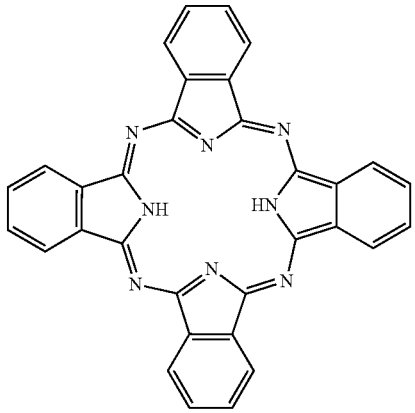

Phthalocyanine-based pigments may be crystalline or non-crystalline. No particular limitations are placed on crystal structure (for example, α-form, β-form, Y-form, V-form, or II-form) of the phthalocyanine-based pigments, and phthalocyanine-based pigments having various crystal structures can be used. An example of crystalline metal-free phthalocyanine is metal-free phthalocyanine having an X-form crystal structure (also referred to below as X-form metal-free phthalocyanine). Examples of crystalline titanyl phthalocyanine include titanyl phthalocyanine having an α-form crystal structure, titanyl phthalocyanine having a β-form crystal structure, and titanyl phthalocyanine having a Y-form crystal structure (also referred to below as α-form titanyl phthalocyanine, β-form titanyl phthalocyanine, and Y-form titanyl phthalocyanine, respectively).

For example, in a digital optical image forming apparatus (for example, a laser beam printer or facsimile machine that uses a light source such as a semiconductor laser), a photosensitive member that is sensitive to light in a wavelength range of at least 700 nm is preferably used. In terms of having high quantum yield in a wavelength range of at least 700 nm, the charge generating material is preferably a phthalocyanine-based pigment, more preferably metal-free phthalocyanine or titanyl phthalocyanine, further preferably X-form metal-free phthalocyanine or Y-form titanyl phthalocyanine, and particularly preferably Y-form titanyl phthalocyanine.

Y-form titanyl phthalocyanine exhibits a main peak at a Bragg angle (2θ±0.2°) of for example 27.2° in a CuKα characteristic X-ray diffraction spectrum. The term main peak refers to a peak that exhibits highest intensity or second highest intensity within a range of Bragg angles (2θ±0.2°) from 3° to 40° in a CuKα characteristic X-ray diffraction spectrum.

An example of a method for measuring the CuKα characteristic X-ray diffraction spectrum is explained below. A sample (titanyl phthalocyanine) is loaded into a sample holder of an X-ray diffraction spectrometer (for example, "RINT (registered Japanese trademark) 1100", product of Rigaku Corporation) and an X-ray diffraction spectrum is measured using a Cu X-ray tube, a tube voltage of 40 kV, a tube current of 30 mA, and CuKα characteristic X-rays having a wavelength of 1.542 Å. The measurement range (20) is for example from 3° to 40° (start angle: 3°, stop angle: 40°), and the scanning speed is for example 10°/minute.

For a photosensitive member employed in an image forming apparatus that uses a short-wavelength laser light source (for example, a laser light source having a wavelength of 350 nm or longer and 550 nm or shorter), an anthanthrone-based pigment is preferably used as the charge generating material.

The amount of the charge generating material is preferably at least 0.1 parts by mass and no greater than 50 parts by mass relative to 100 parts by mass of the binder resin contained in the photosensitive layer, more preferably at least 0.5 parts by mass and no greater than 30 parts by mass, and particularly preferably at least 0.5 parts by mass and no greater than 5 parts by mass.

(Combination of Materials)

In order to inhibit black spot generation on a formed image and an image defect resulting from exposure memory, any of the following combinations of the hole transport material and the binder resin is preferable. Furthermore, it is preferable that a combination of the hole transport material and the binder resin is any of the following combinations and the charge generating material is Y-form titanyl phthalocyanine. It is also preferable that the combination of the hole transport material and the binder resin is any of the following combinations and the charge generating material is X-form metal-free phthalocyanine.

The combinations include:

the compound (11) as the hole transport material and the polycarbonate resin (R1) as the binder resin;

the compound (11) and the compound (12) as the hole transport material and the polycarbonate resin (R1) as the binder resin;

the compound (12) as the hole transport material and the polycarbonate resin (R1) as the binder resin;

the compound (13) as the hole transport material and the polycarbonate resin (R1) as the binder resin;

the compound (14) as the hole transport material and the polycarbonate resin (R1) as the binder resin;

the compound (15) as the hole transport material and the polycarbonate resin (R1) as the binder resin;

the compound (16) as the hole transport material and the polycarbonate resin (R1) as the binder resin;

the compound (17) as the hole transport material and the polycarbonate resin (R1) as the binder resin;

the compound (18) as the hole transport material and the polycarbonate resin (R1) as the binder resin;

the compound (11) as the hole transport material and the polycarbonate resin (R2) as the binder resin;

the compound (11) as the hole transport material and the polycarbonate resin (R3) as the binder resin;

the compound (11) as the hole transport material and the polycarbonate resin (R4) as the binder resin;

the compound (18) as the hole transport material and the polycarbonate resin (R2) as the binder resin; and the compound (19) as the hole transport material and the polycarbonate resin (R2) as the binder resin.

In order to inhibit black spot generation on a formed image and an image defect resulting from exposure memory, any of the following combinations of the hole transport material and the binder resin is more preferable. Furthermore, it is preferable that the combination of the hole transport material and the binder resin is any of the following combinations and the charge generating material is Y-form titanyl phthalocyanine. It is also preferable that the combination of the hole transport material and the binder resin is any of the following combinations and the charge generating material is X-form metal-free phthalocyanine.

The combinations include:

the compound (11-HT1) as the hole transport material and the polycarbonate resin (R1) as the binder resin;

the compound (11-HT2) as the hole transport material and the polycarbonate resin (R1) as the binder resin;

the compound (11-HT1) and the compound (12-HT3) as the hole transport material and the polycarbonate resin (R1) as the binder resin;

the compound (12-HT4) as the hole transport material and the polycarbonate resin (R1) as the binder resin;

the compound (13-HT5) as the hole transport material and the polycarbonate resin (R1) as the binder resin;

the compound (13-HT6) as the hole transport material and the polycarbonate resin (R1) as the binder resin;

the compound (14-HT7) as the hole transport material and the polycarbonate resin (R1) as the binder resin;

the compound (15-HT8) as the hole transport material and the polycarbonate resin (R1) as the binder resin;

the compound (15-HT9) as the hole transport material and the polycarbonate resin (R1) as the binder resin;

the compound (15-HT10) as the hole transport material and the polycarbonate resin (R1) as the binder resin;

the compound (16-HT11) as the hole transport material and the polycarbonate resin (R1) as the binder resin;

the compound (17-HT12) as the hole transport material and the polycarbonate resin (R1) as the binder resin;

the compound (18-HT13) as the hole transport material and the polycarbonate resin (R1) as the binder resin;

the compound (11-HT1) as the hole transport material and the polycarbonate resin (R2) as the binder resin;

the compound (11-HT1) as the hole transport material and the polycarbonate resin (R3) as the binder resin;

the compound (11-HT1) as the hole transport material and the polycarbonate resin (R4) as the binder resin;

the compound (18-HT13) as the hole transport material and the polycarbonate resin (R2) as the binder resin; and the compound (19-HT17) as the hole transport material and the polycarbonate resin (R2) as the binder resin.

In order to inhibit black spot generation on a formed image and an image defect resulting from exposure memory, any of the following combinations of the hole transport material, the binder resin, and the electron transport material is preferable. Furthermore, it is preferable that a combination of the hole transport material, the binder resin, and the electron transport material is any of the following combinations and the charge generating material is Y-form titanyl phthalocyanine. It is also preferable that the combination of the hole transport material, the binder resin, and the electron transport material is any of the following combinations and the charge generating material is X-form metal-free phthalocyanine.

The combinations include:

the compound (11) as the hole transport material, the polycarbonate resin (R1) as the binder resin, and the compound (21) as the electron transport material;

the compound (11) and the compound (12) as the hole transport material, the polycarbonate resin (R1) as the binder resin, and the compound (21) as the electron transport material;

the compound (12) as the hole transport material, the polycarbonate resin (R1) as the binder resin, and the compound (21) as the electron transport material;

the compound (13) as the hole transport material, the polycarbonate resin (R1) as the binder resin, and the compound (21) as the electron transport material;

the compound (14) as the hole transport material, the polycarbonate resin (R1) as the binder resin, and the compound (21) as the electron transport material;

the compound (15) as the hole transport material, the polycarbonate resin (R1) as the binder resin, and the compound (21) as the electron transport material;

the compound (16) as the hole transport material, the polycarbonate resin (R1) as the binder resin, and the compound (21) as the electron transport material;

the compound (17) as the hole transport material, the polycarbonate resin (R1) as the binder resin, and the compound (21) as the electron transport material;

the compound (18) as the hole transport material, the polycarbonate resin (R1) as the binder resin, and the compound (21) as the electron transport material;

the compound (11) as the hole transport material, the polycarbonate resin (R1) as the binder resin, and the compound (22) as the electron transport material;

the compound (11) as the hole transport material, the polycarbonate resin (R1) as the binder resin, and the compound (23) as the electron transport material;

the compound (11) as the hole transport material, the polycarbonate resin (R2) as the binder resin, and the compound (21) as the electron transport material;

the compound (11) as the hole transport material, the polycarbonate resin (R3) as the binder resin, and the compound (21) as the electron transport material;

the compound (11) as the hole transport material, the polycarbonate resin (R4) as the binder resin, and the compound (21) as the electron transport material;

the compound (18) as the hole transport material, the polycarbonate resin (R2) as the binder resin, and the compound (21) as the electron transport material; and the compound (19) as the hole transport material, the polycarbonate resin (R2) as the binder resin, and the compound (21) as the electron transport material.

In order to inhibit black spot generation on a formed image and an image defect resulting from exposure memory, any of the following combinations of the hole transport material, the binder resin, and the electron transport material is more preferable. Furthermore, it is preferable that a combination of the hole transport material, the binder resin, and the electron transport material is any of the following combinations and the charge generating material is Y-form titanyl phthalocyanine. It is also preferable that the combination of the hole transport material, the binder resin, and the electron transport material is any of the following combinations and the charge generating material is X-form metal-free phthalocyanine.

The combinations include:

the compound (11-HT1) as the hole transport material, the polycarbonate resin (R1) as the binder resin, and the compound (ET1) as the electron transport material; the compound (11-HT2) as the hole transport material, the polycarbonate resin (R1) as the binder resin, and the compound (ET1) as the electron transport material;

the compound (11-HT1) and compound (12-HT3) as the hole transport material, the polycarbonate resin (R1) as the binder resin, and the compound (ET1) as the electron transport material;

the compound (12-HT4) as the hole transport material, the polycarbonate resin (R1) as the binder resin, and the compound (ET1) as the electron transport material;

the compound (13-HT5) as the hole transport material, the polycarbonate resin (R1) as the binder resin, and the compound (ET1) as the electron transport material;

the compound (13-HT6) as the hole transport material, the polycarbonate resin (R1) as the binder resin, and the compound (ET1) as the electron transport material;

the compound (14-HT7) as the hole transport material, the polycarbonate resin (R1) as the binder resin, and the compound (ET1) as the electron transport material;

the compound (15-HT8) as the hole transport material, the polycarbonate resin (R1) as the binder resin, and the compound (ET1) as the electron transport material;

the compound (15-HT9) as the hole transport material, the polycarbonate resin (R1) as the binder resin, and the compound (ET1) as the electron transport material;

the compound (15-HT10) as the hole transport material, the polycarbonate resin (R1) as the binder resin, and the compound (ET1) as the electron transport material;

the compound (16-HT11) as the hole transport material, the polycarbonate resin (R1) as the binder resin, and the compound (ET1) as the electron transport material;

the compound (17-HT12) as the hole transport material, the polycarbonate resin (R1) as the binder resin, and the compound (ET1) as the electron transport material;

the compound (18-HT13) as the hole transport material, the polycarbonate resin (R1) as the binder resin, and the compound (ET1) as the electron transport material;

the compound (11-HT1) as the hole transport material, the polycarbonate resin (R1) as the binder resin, and the compound (ET2) as the electron transport material;

the compound (11-HT1) as the hole transport material, the polycarbonate resin (R1) as the binder resin, and the compound (ET3) as the electron transport material;

the compound (11-HT1) as the hole transport material, the polycarbonate resin (R2) as the binder resin, and the compound (ET1) as the electron transport material;

the compound (11-HT1) as the hole transport material, the polycarbonate resin (R3) as the binder resin, and the compound (ET1) as the electron transport material;

the compound (11-HT1) as the hole transport material, the polycarbonate resin (R4) as the binder resin, and the compound (ET1) as the electron transport material;

the compound (18-HT13) as the hole transport material, the polycarbonate resin (R2) as the binder resin, and the compound (ET1) as the electron transport material; and the compound (19-HT17) as the hole transport material, the polycarbonate resin (R2) as the binder resin, and the compound (ET1) as the electron transport material.

(Additive)

Examples of the additive include antidegradants (for examples, antioxidants, radical scavengers, singlet quenchers, and ultraviolet absorbing agents), softeners, surface modifiers, extenders, thickeners, dispersion stabilizers, waxes, acceptors, donors, surfactants, plasticizers, sensitizers, and leveling agents.

<Conductive Substrate>

No particular limitations are placed on the conductive substrate other than being a conductive substrate that can be used as a conductive substrate for a photosensitive member. It is only required that at least a surface portion of the conductive substrate is formed from a conductive material. An example of the conductive substrate is a conductive substrate formed from a conductive material. Another example of the conductive substrate is a conductive substrate covered with a conductive material. Examples of conductive materials include aluminum, iron, copper, tin, platinum, silver, vanadium, molybdenum, chromium, cadmium, titanium, nickel, palladium, indium, stainless steel, and brass. Any one of the conductive materials listed above may be used independently, or any two or more of the conductive materials listed above may be used in combination (for example, as an alloy). Of the conductive materials listed above, aluminum or an aluminum alloy is preferable in terms of favorable charge mobility from the photosensitive layer to the conductive substrate.

The shape of the conductive substrate can be selected appropriately in accordance with the configuration of an image forming apparatus in which the conductive substrate is to be used. The conductive substrate is for example in a sheet shape or a drum shape. The thickness of the conductive substrate is appropriately selected according to the shape of the conductive substrate.

<Intermediate Layer>

The intermediate layer (undercoat layer) for example contains inorganic particles and a resin for intermediate layer use (intermediate layer resin). Provision of the intermediate layer is thought to facilitate flow of current generated when the photosensitive member is exposed to light and inhibit increasing resistance, while also maintaining insulation to a sufficient degree so as to inhibit occurrence of leakage current.

Examples of inorganic particles include particles of metals (examples include aluminum, iron, and copper), particles of metal oxides (examples include titanium oxide, alumina, zirconium oxide, tin oxide, and zinc oxide), and particles of non-metal oxides (for example, silica). Any one type of inorganic particles listed above may be used independently, or any two or more types of organic particles listed above may be used in combination.

No particular limitations are placed on the intermediate layer resin other than being a resin that can be used for intermediate layer formation. The intermediate layer may contain an additive. Examples of the additive that may be contained in the intermediate layer are the same as the examples of the additive that may be contained in the photosensitive layer.

<Photosensitive Member Production Method>

A photosensitive member is for example produced as follows. The photosensitive member is produced by applying an application liquid for photosensitive layer formation onto a conductive substrate and drying the application liquid thereon. The application liquid for photosensitive layer formation is prepared by dissolving or dispersing in a solvent a charge generating material, an electron transport material, a binder resin, a hole transport material, and an optional component to be added as necessary (for example, an additive).

No particular limitations are placed on the solvent contained in the application liquid for photosensitive layer formation other than that components of the application liquid should be soluble or dispersible in the solvent. Examples of the solvent include alcohols (for example, methanol, ethanol, isopropanol, and butanol), aliphatic hydrocarbons (for example, n-hexane, octane, and cyclohexane), aromatic hydrocarbons (for example, benzene, toluene, and xylene), halogenated hydrocarbons (for example, dichloromethane, dichloroethane, carbon tetrachloride, and chlorobenzene), ethers (for example, dimethyl ether, diethyl ether, tetrahydrofuran, ethylene glycol dimethyl ether, diethylene glycol dimethyl ether, and propylene glycol monomethyl ether), ketones (for example, acetone, methyl ethyl ketone, and cyclohexanone), esters (for example, ethyl acetate and methyl acetate), dimethyl formaldehyde, dimethyl formamide, and dimethyl sulfoxide. Any one of the solvents listed above may be used independently, or any two or more of the solvents listed above may be used in combination. In order to improve workability in production of the photosensitive member, a non-halogenated solvent (i.e., a solvent other than a halogenated hydrocarbon) is preferably used.

The application liquid is prepared by mixing the components in order to disperse the components in the solvent. Mixing or dispersion can for example be performed using a bead mill, a roll mill, a ball mill, an attritor, a paint shaker, or an ultrasonic disperser.

The application liquid for photosensitive layer formation may for example further contain a surfactant in order to improve dispersibility of the components.

No particular limitations are placed on the method by which the application liquid for photosensitive layer formation is applied so long as the method enables uniform application of the application liquid onto a conductive substrate. Examples of application methods that can be used include blade coating, dip coating, spray coating, spin coating, and bar coating.

No particular limitations are placed on the method by which the application liquid for photosensitive layer formation is dried other than being a method for evaporating the solvent contained in the application liquid. The method of drying may for example be heat treatment (hot-air drying) using a high-temperature dryer or a reduced pressure dryer. The temperature of the heat treatment is for example 40° C.

or higher and 150° C. or lower. Heat treatment time is for example 3 minutes or longer and 120 minutes or shorter.

Note that the photosensitive member production method may further include either or both intermediate layer formation and protective layer formation as necessary. Any known method is selected as appropriate for each of the intermediate layer formation and the protective layer formation.

<Image Forming Apparatus>

The following describes an image forming apparatus including the photosensitive member according to the present embodiment. The following describes an aspect of the image forming apparatus including the photosensitive member of the present embodiment through use of an example of a tandem color image forming apparatus adopting a direct transfer process as with reference to FIG. 3.

Figure 3:
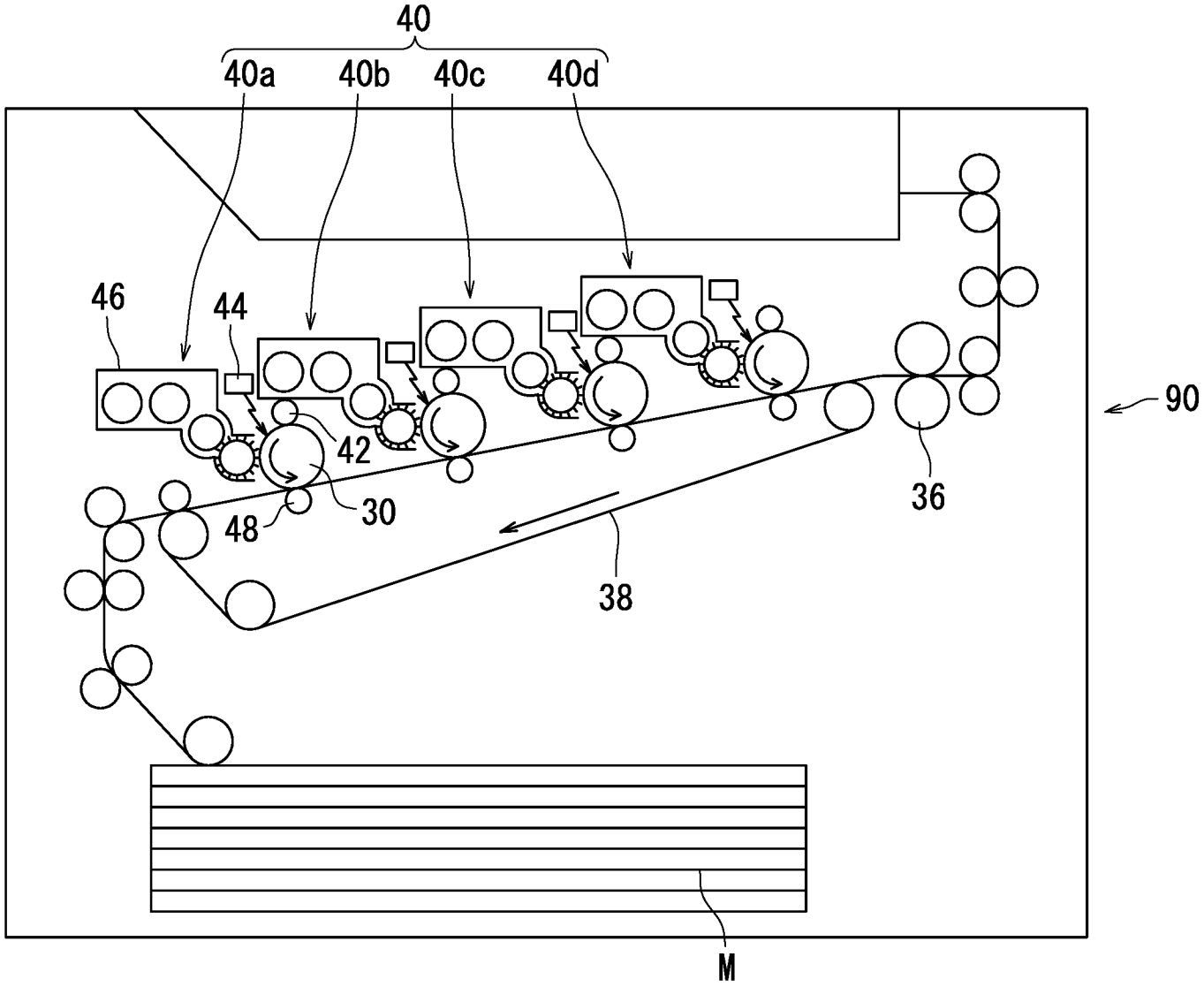
FIG. 3 is a diagram illustrating an example of an image forming apparatus that includes the electrophotographic photosensitive member according to the embodiment of the present invention.

An image forming apparatus 90 illustrated in FIG. 3 includes image forming units 40*a*, 40*b*, 40*c*, and 40*d*, a transfer belt 38, and a fixing section 36. Hereinafter, each of the image forming units 40*a*, 40*b*, 40*c*, and 40*d* is referred to as image forming unit 40 where it is not necessary to distinguish among the image forming units 40*a*, 40*b*, 40*c*, and 40*d*.

The image forming unit 40 includes an image bearing member 30, a charger 42, a light exposure section 44, a developing section 46, and a transfer section 48. The image bearing member 30 is the photosensitive member 1 according to the present embodiment. The image bearing member 30 is disposed at a central position in the image forming unit 40. The image bearing member 30 is rotatable in an arrow direction (counterclockwise direction). The charger 42, the light exposure section 44, the developing section 46, and the transfer section 48 are disposed around the image bearing member 30 in the stated order from upstream in a rotational direction of the image bearing member 30 starting from the charger 42 as a reference. The image forming unit 40 may further include either or both a cleaner (not illustrated: specifically, a blade cleaner) and a static eliminating section (not illustrated). Note that the image forming unit 40 may not include the cleaning blade. That is, the image forming apparatus 90 can adopt a process without blade cleaning.

Toner images in plural colors (for example, four colors of black, cyan, magenta, and yellow) are sequentially superimposed on a recording medium M on the transfer belt 38 by the respective image forming units 40*a* to 40*d*.

The charger 42 charges a surface (specifically, a circumferential surface) of the image bearing member 30. The charger 42 has a positive charging polarity. That is, the charger 42 positively charges the surface of the image bearing member 30.

The charger 42 is a charging roller. The charging roller charges the surface of the image bearing member 30 while in contact with the surface of the image bearing member 30. The image forming apparatus 90 adopts a contact charging process. An example of a charger adopting the contact charging process other than the charging roller is a charging brush. Note that the charger may adopt a non-contact charging process. Examples of a charger adopting the non-contact charging process include a corotron charger and a scorotron charger.

The light exposure section 44 exposes the charged surface of the image bearing member 30 to light. As a result of exposure, an electrostatic latent image is formed on the surface of the image bearing member 30. The electrostatic latent image is formed based on image data input to the image forming apparatus 90.

The developing section 46 supplies a toner to the surface of the image bearing member 30. Through toner supply, the developing section 46 develops the electrostatic latent image into a toner image. Thus, the image bearing member 30 bears the toner image. A developer used may be a one-component developer or a two-component developer. In a situation in which the developer is a one-component developer, the developing section 46 supplies a toner that is the one-component developer to the electrostatic latent image formed on the surface of the image bearing member 30. In a situation in which the developer is a two-component developer, the developing section 46 supplies a toner of the two-component developer including the toner and a carrier to the electrostatic latent image formed on the surface of the image bearing member 30.

A time from exposure by the light exposure section 44 to development by the developing section 46 on a specific portion of the surface of the image bearing member 30 (also referred to below as process time between exposure and development) is 100 milliseconds or shorter. More specifically, the process time between exposure and development is a time from when the light exposure section 44 starts irradiating the specific portion of the surface of the image bearing member 30 with exposure light to when the developing section 46 starts supplying the toner to the specific portion thereof. The specific portion of the surface of the image bearing member 30 is for example one location in a to-be-exposed region of the circumferential surface of the image bearing member 30. The process time between exposure and development corresponds to a peripheral speed of the image bearing member 30.

Typically, the peripheral speed of an image bearing member is high and time it takes to clean toner and an external additive of the toner remaining on the surface of the image bearing member is short when the process time between exposure and development is 100 milliseconds or shorter. For the reason as above, black spots tend to be generated on a formed image. In particular, black spots tend to be generated on a formed image in a high-temperature and high-humidity environment. Furthermore, charge tends to remain in a photosensitive layer of the image bearing member because the peripheral speed of the image bearing member is high when the process time between exposure and development is 100 milliseconds or shorter. For the reason as above, an image defect resulting from exposure memory tends to be produced. However, the image forming apparatus 90 includes the photosensitive member 1 according to the present embodiment as the image bearing member 30. The photosensitive member 1 can inhibit black spot generation on a formed image and an image defect resulting from exposure memory. Therefore, the image forming apparatus 90 including the photosensitive member 1 as the image bearing member 30 can inhibit black spot generation on a formed image and an image defect resulting from exposure memory even in a configuration in which the process time between exposure and development is 100 milliseconds or shorter.

The process time between exposure and development is preferably longer than 0 milliseconds and shorter than or equal to 100 milliseconds, more preferably 50 milliseconds or longer and 90 milliseconds or shorter, and further preferably 65 milliseconds or longer and 70 milliseconds or shorter.

The transfer belt 38 conveys the recording medium M to a location between the image bearing member 30 and the transfer section 48. The transfer belt 38 is an endless belt.

The transfer belt 38 is capable of circulating in an arrow direction (clockwise direction).

The transfer section 48 transfers the toner image developed by the developing section 46 from the surface of the image bearing member 30 to a transfer target. The transfer target is the recording medium M. The transfer section 48 may for example be a transfer roller.

A region of the surface of the image bearing member 30 from which the toner image has been transferred to the recording medium M, which is the transfer target, by the transfer section 48 is re-charged by the charger 42 without being subjected to static elimination. That is, the image forming apparatus 90 can adopt a process without static elimination. Typically, charge tends to remain in a photosensitive layer of an image berating member in an image forming apparatus adopting the process without static elimination. For the reason as above, an image defect resulting from exposure memory tends to be produced. However, the image forming apparatus 90 includes the photosensitive member 1 according to the present embodiment as the image bearing member 30. The photosensitive member 1 can inhibit an image defect resulting from exposure memory. Therefore, the image forming apparatus 90 including the photosensitive member 1 as the image bearing member 30 can inhibit an image defect resulting from exposure memory even in a configuration in which the process without static elimination is adopted.

The fixing section 36 applies either or both heat and pressure to the unfixed toner image transferred to the recording medium M by the transfer section 48. The fixing section 36 includes for example either or both a heating roller and a pressure roller. Application of either or both heat and pressure to the toner image results in fixing of the toner image to the recording medium M. Through the above, an image is formed on the recording medium M.

Although an example of the image forming apparatus has been described so far, the image forming apparatus is not limited to the above-described image forming apparatus 90. The above-described image forming apparatus 90 is a color image forming apparatus, but the image forming apparatus may be a monochrome image forming apparatus. In a case as above, the image forming apparatus may include only one image forming unit, for example. The above-described image forming apparatus 90 is a tandem image forming apparatus, but the image forming apparatus may be for example a rotary image forming apparatus. The above-described image forming apparatus 90 adopts a direct transfer process, but the image forming apparatus may adopt for example an intermediate transfer process. In a case as above, the transfer section corresponds to a primary transfer section and a secondary transfer section, and the transfer target corresponds to a recording medium and a transfer belt.

<Process Cartridge>

The following describes an example of a process cartridge including the photosensitive member 1 of the present embodiment with further reference to FIG. 3. The process cartridge is a cartridge for image formation. The process cartridge corresponds to each of the image forming units 40*a* to 40*d*. The process cartridge includes the image bearing member 30. The image bearing member 30 is the photosensitive member 1 according to the present embodiment. The process cartridge may include at least one selected from the group consisting of the charger 42, the light exposure section 44, the developing section 46, and the transfer section 48 in addition to the photosensitive member 1. The process cartridge may further include either or both a cleaner (not illustrated) and a static eliminating section (not illustrated). The process cartridge may be designed to be freely attachable to and detachable from the image forming apparatus 90. In the above configuration, the process cartridge is easy to handle and can therefore be easily and quickly replaced, together with the photosensitive member 1, when sensitivity characteristics or the like of the photosensitive member 1 deteriorate. The process cartridge including the photosensitive member 1 according to the present embodiment has been described so far with reference to FIG. 3.

Examples

The following provides more specific description of the present invention through use of Examples. However, the present invention is not limited to the scope of the Examples.

<Materials for Photosensitive Layer Formation>

The following electron transport materials, hole transport materials, charge generating materials, and binder resins were prepared as materials for forming photosensitive layers of photosensitive members.

(Electron Transport Material)

The compounds (ET1) to (ET3) described in association with the embodiment were each prepared as an electron transport material.

(Hole Transport Material)

The compounds (11-HT1), (11-HT2), (12-HT3), (12-HT4), (13-HT5), (13-HT6), (14-HT7), (15-HT8), (15-HT9), (15-HT10), (16-HT11), (17-HT12), (18-HT13), and (19-HT17) described in association with the embodiment were each prepared as a hole transport material. In addition, compounds represented by chemical formulas (HT14) to (HT16) (also referred to below as compounds (HT14) to (HT16), respectively) were each prepared as a hole transport material used in Comparative Examples.

(HT14)

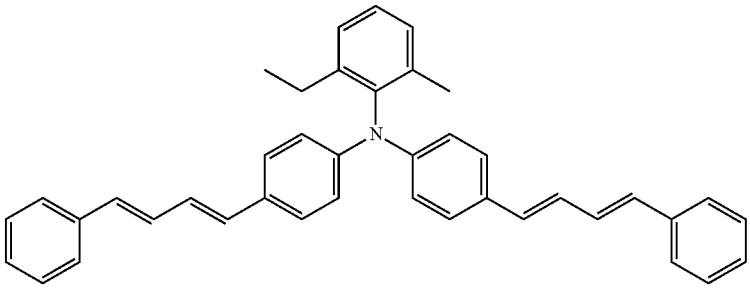

-continued (HT15)

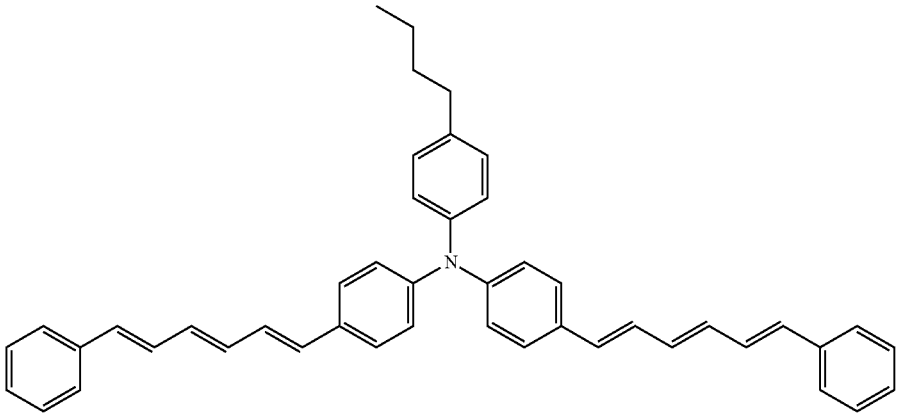

(HT16)

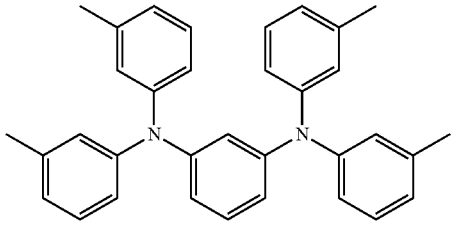

(Charge Generating Material)

Y-form titanyl phthalocyanine and X-form metal-free phthalocyanine were each prepared as a charge generating material. Y-form titanyl phthalocyanine was titanyl phthalocyanine having a Y-form crystal structure and represented by chemical formula (CG1) described in association with the embodiment (also referred to below as compound (CG1)). X-form metal-free phthalocyanine was metal-free phthalocyanine having an X-form crystal structure and represented by chemical formula (CG2) described in association with the embodiment (also referred to below as compound (CG2)).

(Binder Resin)

The polycarbonate resins (R1) to (R4) described in association with the embodiment were each prepared as a binder resin. Each of the polycarbonate resins (R1), (R2), (R3), and (R4) had a viscosity average molecular weight of 40,000.

<Photosensitive Member Production>

Photosensitive members (A-1) to (A-25) and (B-1) to (B-7) were produced using the materials for photosensitive layer formation.

(Production of Photosensitive Member (A-1))

A container was charged with 3 parts by mass of the compound (CG1) as a charge generating material, 150 parts by mass of the compound (11-HT1) as a hole transport material, 75 parts by mass of the compound (ET1) as an electron transport material, 100 parts by mass of the polycarbonate resin (R1) as a binder resin, and 800 parts by mass of tetrahydrofuran as a solvent. The container contents were mixed for 50 hours using a ball mill in order to disperse the materials in the solvent. Through the above, an application liquid for photosensitive layer formation was obtained. The application liquid for photosensitive layer formation was applied onto a conductive substrate (dram-shaped aluminum support, diameter: 30 mm, total length: 247.5 mm) by dip coating. After the application, the application liquid for photosensitive layer formation was hot-air dried for 60 minutes at 120° C. Thus, a photosensitive layer of a single layer (film thickness 28 μm) was formed on the conductive substrate. A photosensitive member (A-1) was obtained as a result of the process described above.

(Production of Photosensitive Members (A-2) to (A-25) and (B-1) to (B-7))

Photosensitive members (A-2) to (A-25) and (B-1) to (B-7) were each produced by the same method as for the photosensitive member (A-1) in all aspects other than the following changes. While the compound (CG1) was used as a charge generating material in production of the photosensitive member (A-1), charge generating materials of types shown in Tables 1 and 2 were used in production of the respective photosensitive members (A-2) to (A-25) and (B-1) to (B-7). While 150 parts by mass of the compound (11-HT1) was used as a hole transport material in production of the photosensitive member (A-1), hole transport materials of types in amounts shown in Tables 1 and 2 were used in production of the respective photosensitive members (A-2) to (A-25) and (B-1) to (B-7). While 75 parts by mass of the compound (ET1) was used as an electron transport material in production of the photosensitive member (A-1), electron transport materials of types in amounts shown in Tables 1 and 2 were used in production of the respective photosensitive members (A-2) to (A-25) and (B-1) to (B-7). While the polycarbonate resin (R1) was used as a binder resin in production of the photosensitive member (A-1), binder resins of types shown in Tables 1 and 2 were used in production of the respective photosensitive members (A-2) to (A-25) and (B-1) to (B-7).

<Measurement of Martens Hardness>

With respect to each of the photosensitive members (A-1) to (A-25) and (B-1) to (B-7), a Martens hardness of its photosensitive layer at 50° C. was measured. The Martens hardness of the photosensitive layer at 50° C. was measured by a nanoindentation method in accordance with ISO14577 standard. The Martens hardness of the photosensitive layer at 50° C. was measured in a measurement environment at a temperature of 23° C. and a relative humidity of 50%. First, the temperature of the photosensitive layer of the photosensitive member was raised to 50° C. using a heater. The Martens hardness of the photosensitive layer was measured using a hardness tester ("FISCHERSCOPE (registered Japanese trademark) HM2000XYp", product of FISCHER INSTRUMENTS K.K.) while the temperature of the photosensitive layer was kept at 50° C. Specifically, an indenter (diamond indenter having a quadrangular pyramid shape with an angle between the opposite faces of 135 degrees) of the hardness tester was brought into contact with a surface of the photosensitive layer. Next, a load gradually increasing at a rate of 10 mN per 20 seconds was applied to the indenter. Once the load reached 10 mN, the indenter was held for 5 seconds. After the 5-second holding, the load applied to the indenter was gradually unloaded over 20 seconds. Measured Martens harnesses of the photosensitive layers at 50° C. are shown in Tables 1 and 2.

<Measurement of Optical Response Time>

An optical response time of each of the photosensitive members (A-1) to (A-25) and (B-1) to (B-7) was measured. The optical response time was measured in a measurement environment at a temperature of 25° C. and a relative humidity of 50%.

Figure 4:
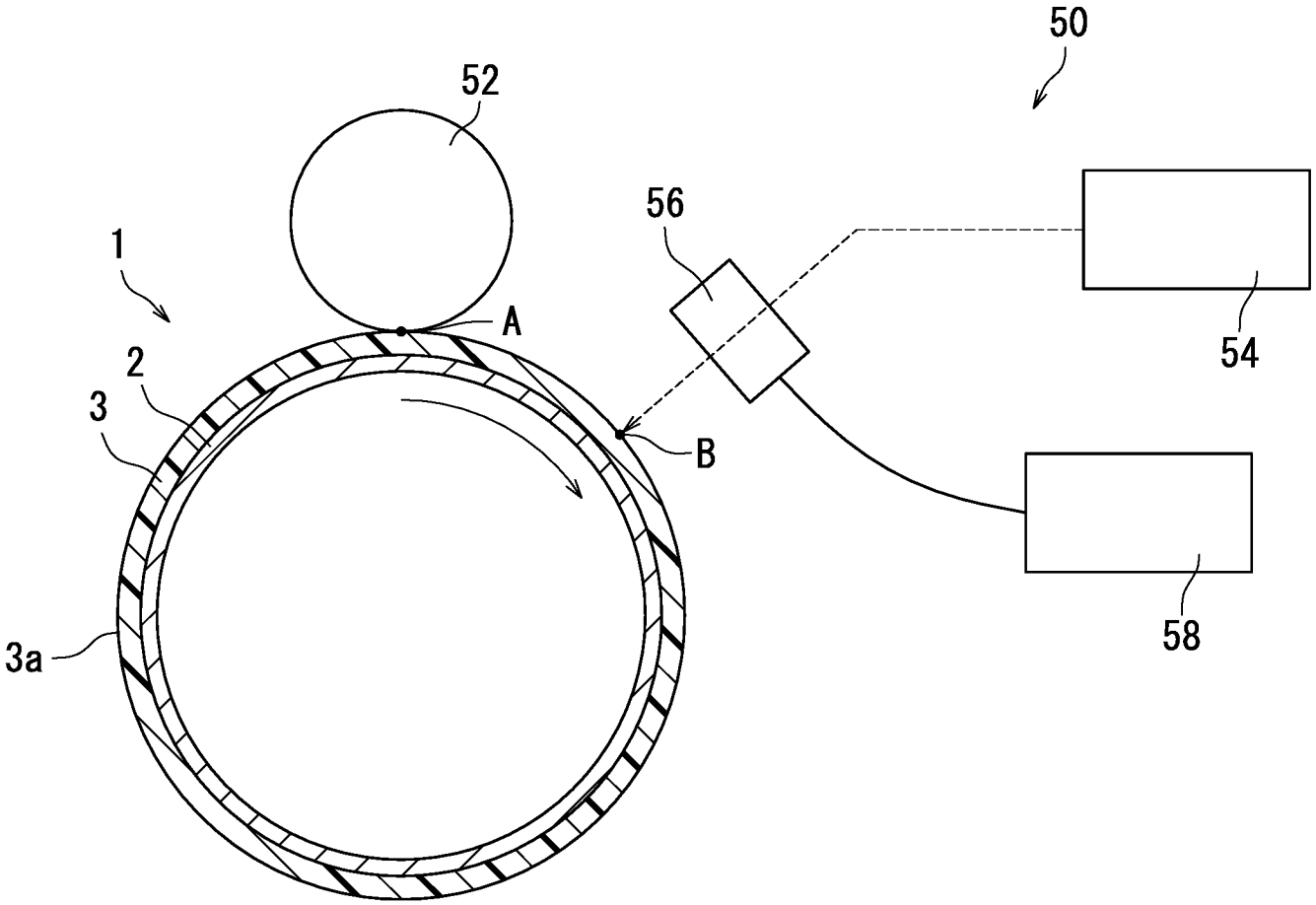
FIG. 4 is a diagram illustrating an optical response time measuring device.

The following describes a method for measuring an optical response time of the photosensitive member 1 with reference to FIG. 4. FIG. 4 illustrates a measuring device 50 for measuring an optical response time of the photosensitive member 1. The measuring device 50 includes a charger 52, a light exposure device 54, a transparent probe 56, and a potential detector 58. A drum sensitivity test device (product of Gen-Tech, Inc.) was used as the measuring device 50. First, the photosensitive member 1 (specifically, any of the photosensitive members (A-1) to (A-25) and (B-1) to (B-7)) was attached to the measuring device 50.

A surface 3*a* of the photosensitive layer 3 of the photosensitive member 1 was charged to +800 V by the charger 52. In the above manner, the surface 3*a* of the photosensitive layer 3 was charged to +800 V at a charge position A. The charge position A was a position where the charger 52 was in contact with the surface 3*a* of the photosensitive layer 3.

The photosensitive member 1 was rotated in a direction from the charge position A to an exposure position B (direction indicated by a solid arrow in FIG. 4) to move a charged part of the surface 3*a* of the photosensitive layer 3 to the exposure position B. The exposure position B was a position to be irradiated with pulse light. After the movement, the rotation of the photosensitive member 1 was stopped and the photosensitive member 1 was immobilized. A potential (surface potential) of the surface 3*a* of the photosensitive layer 3 was measured with the photosensitive member 1 secured. The light exposure device 54 irradiated the charged part of the surface 3*a* of the photosensitive layer 3 with pulse light (wavelength: 780 nm, half-width: 40 microseconds) at the exposure position B. After 400 milliseconds elapse from the irradiation of the surface 3*a* of the photosensitive layer 3 charged to +800 V with the pulse light, the pulse light was set to have a light intensity that allowed the surface potential of the photosensitive layer 3 to decay to +200 V from +800 V. The irradiation with the pulse light was performed one time. That is, one-pulse irradiation was performed. A xenon flash lamp ("C4479", product of Hamamatsu Photonics K.K.) was used as a light source of the light exposure device 54. The wavelength and the light intensity of the pulse light was adjusted using an optical filter (not illustrated). Strictly, the surface 3*a* of the photosensitive layer 3 was charged to a value slightly higher than +800 V by the charger 52. When the surface potential of the photosensitive layer 3 dark decayed to +800 V then through elapse of a specific time period, the surface 3*a* of the photosensitive layer 3 was irradiated with the pulse light by the light exposure device 54.

The surface potential of the photosensitive layer 3 was measured through the transparent probe 56. The transparent probe 56 was set along an optical axis of the pulse light and allowed the pulse light to pass therethrough. A broken line arrow in a direction from the light exposure device 54 to the photosensitive member 1 in FIG. 4 indicates the optical axis of the pulse light. A probe ("3629A", product of TREK JAPAN KK) was used as the transparent probe 56.

The potential detector 58 was electrically connected to the transparent probe 56. A surface potential of the photosensitive layer 3 in each time of measurement by the transparent probe 56 was obtained from the potential detector 58. Through the above, a surface potential decay curve of the photosensitive layer 3 was plotted. A time $\tau$ from the irradiation of the surface 3*a* of the photosensitive layer 3 with the pulse light to the decay of the surface potential of the photosensitive layer 3 from +800 V to +400 V was determined from the plotted decay curve. The determined time $\tau$ was taken to be an optical response time. The method for measuring an optical response time of the photosensitive member 1 has been described so far with reference to FIG. 4. Optical response times of the photosensitive members measured as above are shown in Tables 1 and 2.

<Image Evaluation: Image Defect Resulting from Exposure Memory>

With respect to each of the photosensitive members (A-1) to (A-25) and (B-1) to (B-7), whether or not an image defect resulting from exposure memory was inhibited was evaluated. Evaluation of an image defect resulting from exposure memory was performed in an environment at a temperature of 10° C. and a relative humidity of 15%.

The photosensitive member was attached to an evaluation apparatus. The evaluation apparatus used was a modified version of a color image forming apparatus ("FS-05250DN", product of KYOCERA Document Solutions Inc.). The evaluation apparatus included a scorotron charger as a charger. The evaluation apparatus included neither a static eliminating section nor a cleaning blade as a cleaner. The charge potential was set to +700 V. The peripheral speed of the photosensitive member was adjusted so that the process time between exposure and development was 75 milliseconds.

Figure 5:
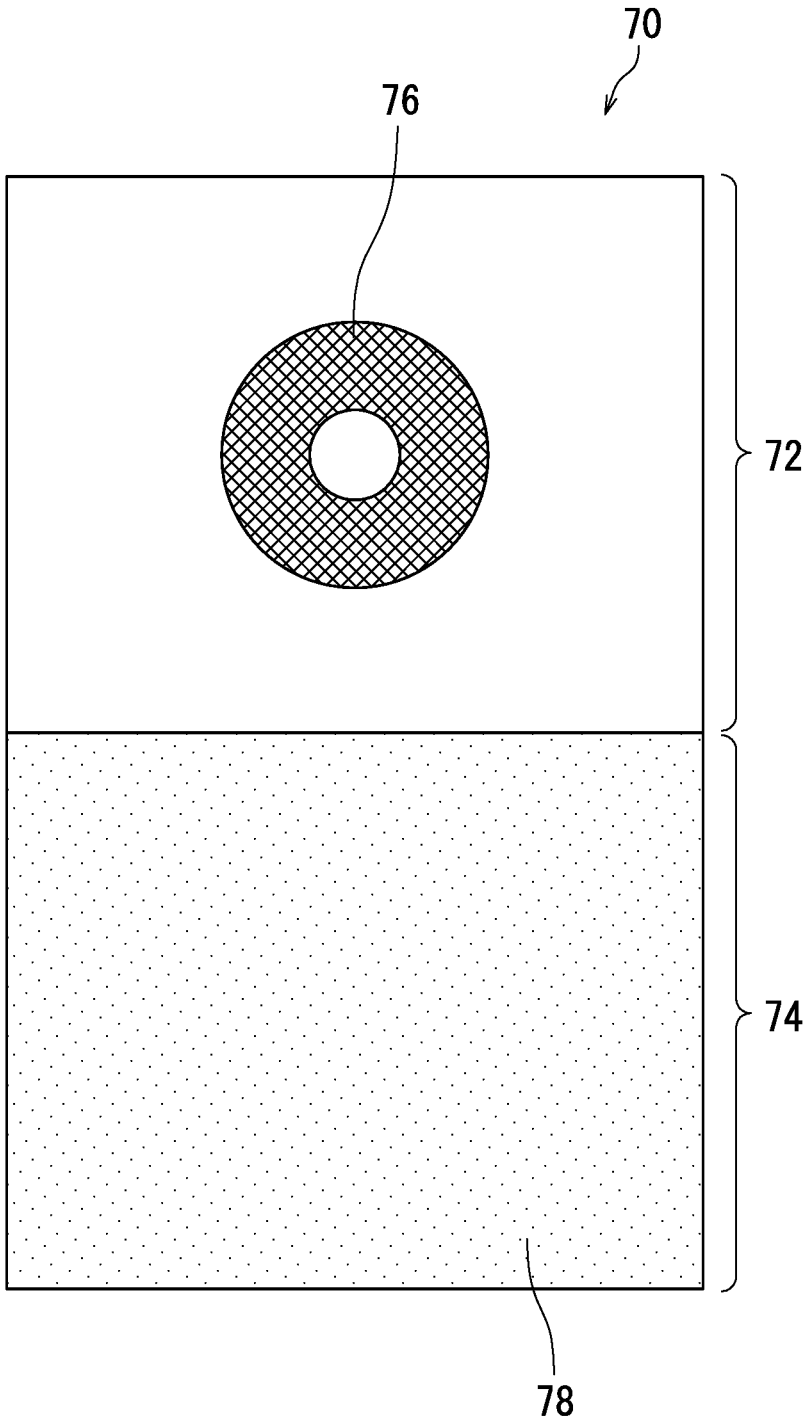
FIG. 5 is a diagram illustrating an evaluation image.

The following describes an evaluation image 70 used for evaluation of an image defect resulting from exposure memory with reference to FIG. 5. FIG. 5 illustrates the evaluation image 70. The evaluation image 70 includes a first area 72 and a second area 74. The first area 72 corresponds to an area of an image formed during a first rotation of an image bearing member. The first area 72 includes a first image 76. The first image 76 is constituted by a donut-shaped solid image (image density: 100%). The solid image is constituted by a pair of two concentric circles. The second area 74 corresponds to an area of an image formed during a second rotation of the image bearing member. The second area 74 includes a second image 78. The second image 78 is constituted by a full-range halftone image (image density: 40%).

Figure 6:
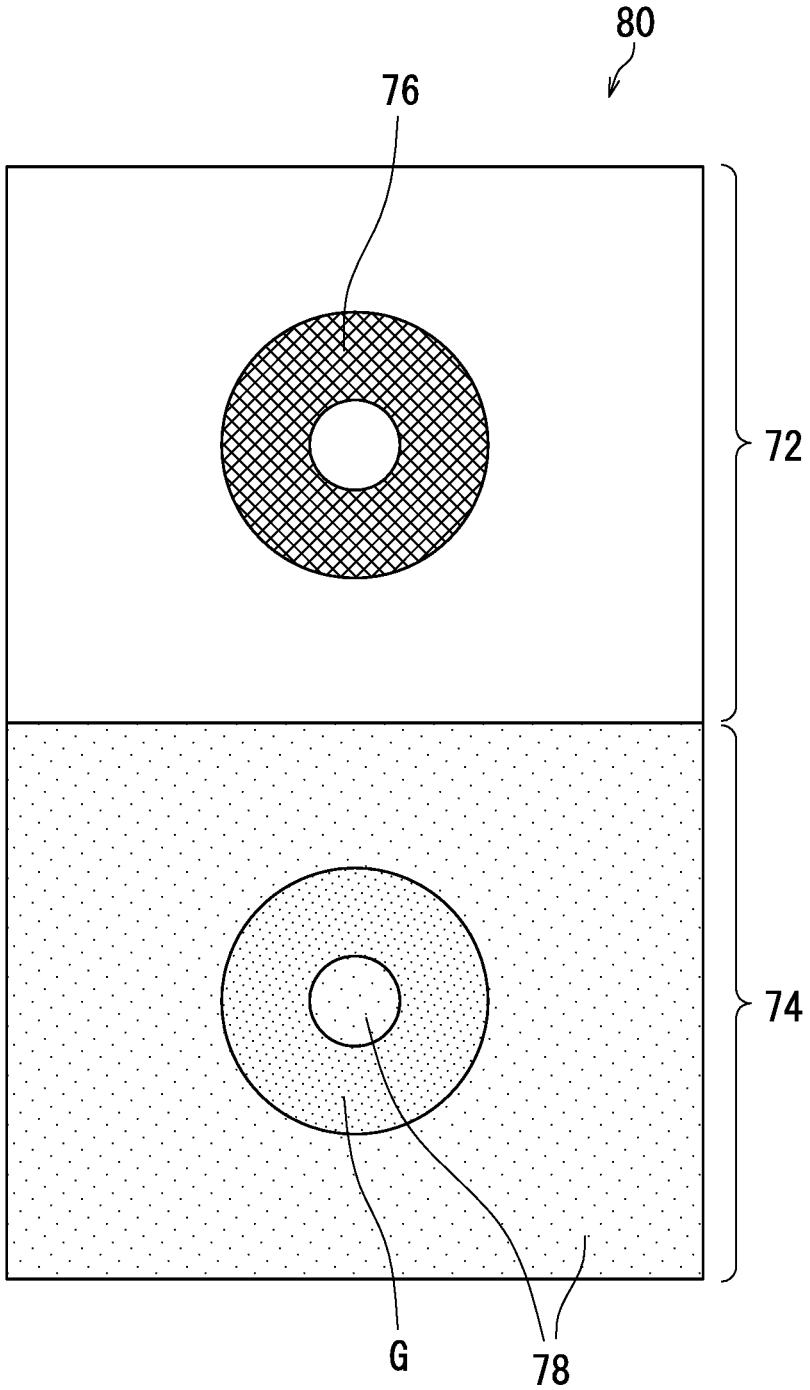
FIG. 6 is a diagram illustrating an image on which an image defect resulting from exposure memory has been produced.

The following describes an image 80 in which an image defect resulting from exposure memory has been produced with reference to FIG. 6. FIG. 6 illustrates the image 80 in which an image defect resulting for exposure memory has been produced. The image 80 includes the first area 72, the second area 74, the first image 76, and the second image 78 described in association with the evaluation image 70. When an image defect resulting from exposure memory is produced through printing of the evaluation image 70, a ghost image G appears in the second image 78 in the second area 74 where the second image 78 should have been printed. The image density of the ghost image G is higher than the second image 78. The ghost image G is an image defect resulting from exposure memory by which image density is higher than a designed image density through reflection of the first image 76 in an exposure region of the first area 72.

First, an image (print pattern image having a coverage of 4%) was printed on 2,000 recording medium (A4-size paper) sheets at regular intervals of 15 seconds using the evaluation apparatus. After the printing of 2,000 recording medium sheets, the evaluation image 70 illustrated in FIG. 5 was printed on a recording medium (A4-size paper) sheet. The printed evaluation image 70 was observed with unaided eyes to check presence or absence of an image defect resulting from exposure memory. Specifically, whether or not the ghost image G corresponding to the first image 76 had occurred in the second area 74 of the evaluation image 70 was confirmed. An image defect resulting from exposure memory was evaluated on results of observation on the evaluation image 70 in accordance with the following standards. The evaluation results are shown in Tables 3 and 4. Note that a photosensitive member rated as any of A to C was evaluated as a photosensitive member by which an image defect resulting from exposure memory had been inhibited.

(Evaluation Standards for Image Defect Resulting from Exposure Memory)

Evaluation A: The ghost image G was not observed.

Evaluation B: The ghost image G was faintly observed.

Evaluation C: The ghost image G at a level that involved no practical problem was observed.

Evaluation D: The ghost image G with a level that involved a practical problem was observed.

<Image Evaluation: Black Spot>

With respect to each of the photosensitive members (A-1) to (A-25) and (B-1) to (B-7), whether or not black spot generation on a formed image was inhibited was evaluated. Evaluation as to black spots was performed in an environment at a temperature of 32° C. and a relative humidity of 80%.

The photosensitive member was attached to an evaluation apparatus. The evaluation apparatus used for evaluation as to black spots was the same as the evaluation apparatus used for evaluation of an image defect resulting from exposure memory. The charge potential was set to +700 V. The peripheral speed of the photosensitive member was adjusted so that the process time between exposure and development was 60 milliseconds.

First, a blank image was successively printed on 2,000 recording medium (A4-size paper) sheets. The evaluation apparatus was then left to stand for 24 hours. Next, a blank image was printed on a recording medium (A4-size paper) sheet. The blank image printed after the evaluation apparatus had been left to stand for 24 hours was observed with unaided eyes to count the number of black spots with a major axis of 0.1 mm or larger generated on the blank image. The numbers of the black spots are listed in Tables 3 and 4. Note that a photosensitive member that had generated a smaller number of black spots was evaluated as a photosensitive member that had more inhibited black spot generation on a formed image.

In Tables 1 and 2, CGM, HTM, ETM, Resin, Hardness, Part, wt %, CG2, and CG1 respectively represent charge generating material, hole transport material, electron transport material, binder resin, Martens hardness of photosensitive layer at 50° C., part by mass, percent by mass, X-form metal-free phthalocyanine, and Y-form titanyl phthalocyanine. "11-HT1/12-HT3" for a type of the hole transport material and "75/75" for an amount of the hole transport material for the photosensitive member (A-7) in Table 1 indicate that 75 parts by mass of the compound (11-HT1) and 75 parts by mass of the compound (12-HT3) were used as the hole transport material.

In Tables 1 and 2, "Content" under a column "HTM" indicates a content of the hole transport material relative to mass of the photosensitive layer. The content of the hole transport material relative to the mass of the photosensitive layer was calculated in accordance with an expression "content (unit: % by mass)=100×amount of hole transport material (unit: part by mass)/[amount of charge generating material (unit: part by mass)+amount of hole transport material (unit: part by mass)+amount of electron transport material (unit: part by mass)+amount of binder resin (unit: part by mass)]".

In Tables 1 and 2, "Ratio $m_{HTM}/m_{ETM}$" indicates a ratio $m_{HTM}/m_{ETM}$ of mass $m_{HTM}$ of the hole transport material to mass $m_{ETM}$ of the electron transport material. The ratio $m_{HTM}/m_{ETM}$ was calculated in accordance with an equation "ratio $m_{HTM}/m_{ETM}$=amount of hole transport material (unit: part by mass)/amount of electron transport material (unit: part by mass).

TABLE 1

| | | Photosensitive layer | | | | | | | | | |
|---|---|---|---|---|---|---|---|---|---|---|---|
| | | | HTM | | | ETM | | Ratio | | | Optical |
| | Photosensitive member | CGM Type | Type | Amount [part] | Content [wt %] | Type | Amount [part] | $m_{HTM}/m_{ETM}$ | Resin Type | Hardness [N/mm$^2$] | response time [millisecond] |
| Example 1 | A-1 | CG1 | 11-HT1 | 150 | 46 | ET1 | 75 | 2.0 | R1 | 181 | 0.32 |
| Example 2 | A-2 | CG1 | 11-HT1 | 90 | 38 | ET1 | 45 | 2.0 | R1 | 189 | 0.75 |
| Example 3 | A-3 | CG1 | 11-HT1 | 220 | 51 | ET1 | 110 | 2.0 | R1 | 175 | 0.26 |
| Example 4 | A-4 | CG1 | 11-HT1 | 180 | 53 | ET1 | 55 | 3.3 | R1 | 186 | 0.28 |
| Example 5 | A-5 | CG1 | 11-HT1 | 160 | 44 | ET1 | 100 | 1.6 | R1 | 184 | 0.81 |
| Example 6 | A-6 | CG1 | 11-HT2 | 150 | 46 | ET1 | 75 | 2.0 | R1 | 181 | 0.46 |
| Example 7 | A-7 | CG1 | 11-HT1/ 12-HT3 | 75/ 75 | 46 | ET1 | 75 | 2.0 | R1 | 185 | 0.30 |
| Example 8 | A-8 | CG1 | 12-HT4 | 150 | 46 | ET1 | 75 | 2.0 | R1 | 184 | 0.33 |
| Example 9 | A-9 | CG1 | 13-HT5 | 150 | 46 | ET1 | 75 | 2.0 | R1 | 188 | 0.59 |
| Example 10 | A-10 | CG1 | 13-HT6 | 150 | 46 | ET1 | 75 | 2.0 | R1 | 186 | 0.55 |
| Example 11 | A-11 | CG1 | 14-HT7 | 150 | 46 | ET1 | 75 | 2.0 | R1 | 185 | 0.30 |
| Example 12 | A-12 | CG1 | 15-HT8 | 150 | 46 | ET1 | 75 | 2.0 | R1 | 186 | 0.43 |

TABLE 1-continued

| | | Photosensitive layer | | | | | | | | | |
|---|---|---|---|---|---|---|---|---|---|---|---|
| | | | HTM | | | ETM | | Ratio | | | Optical |
| | Photosensitive member | CGM Type | Type | Amount [part] | Content [wt %] | Type | Amount [part] | $m_{HTM}/m_{ETM}$ | Resin Type | Hardness [N/mm$^2$] | response time [millisecond] |
| Example 13 | A-13 | CG1 | 15-HT9 | 150 | 46 | ET1 | 75 | 2.0 | R1 | 186 | 0.52 |
| Example 14 | A-14 | CG1 | 15-HT10 | 150 | 46 | ET1 | 75 | 2.0 | R1 | 186 | 0.49 |
| Example 15 | A-15 | CG1 | 16-HT11 | 150 | 46 | ET1 | 75 | 2.0 | R1 | 174 | 0.60 |

TABLE 2

| | | Photosensitive layer | | | | | | | | | |
|---|---|---|---|---|---|---|---|---|---|---|---|
| | | | HTM | | | ETM | | Ratio | | | Optical |
| | Photosensitive member | CGM Type | Type | Amount [part] | Content [wt %] | Type | Amount [part] | $m_{HTM}/m_{ETM}$ | Resin Type | Hardness [N/mm$^2$] | response time [millisecond] |
| Example 16 | A-16 | CG1 | 17-HT12 | 150 | 46 | ET1 | 75 | 2.0 | R1 | 176 | 0.46 |
| Example 17 | A-17 | CG1 | 18-HT13 | 150 | 46 | ET1 | 75 | 2.0 | R1 | 181 | 0.24 |
| Example 18 | A-18 | CG1 | 11-HT1 | 150 | 46 | ET2 | 75 | 2.0 | R1 | 180 | 0.32 |
| Example 19 | A-19 | CG1 | 11-HT1 | 150 | 46 | ET3 | 75 | 2.0 | R1 | 181 | 0.33 |
| Example 20 | A-20 | CG1 | 11-HT1 | 150 | 46 | ET1 | 75 | 2.0 | R2 | 183 | 0.32 |
| Example 21 | A-21 | CG1 | 11-HT1 | 150 | 46 | ET1 | 75 | 2.0 | R3 | 182 | 0.33 |
| Example 22 | A-22 | CG1 | 11-HT1 | 150 | 46 | ET1 | 75 | 2.0 | R4 | 181 | 0.35 |
| Example 23 | A-23 | CG2 | 11-HT1 | 150 | 46 | ET1 | 75 | 2.0 | R1 | 180 | 0.34 |
| Example 24 | A-24 | CG1 | 18-HT13 | 150 | 46 | ET1 | 75 | 2.0 | R2 | 183 | 0.23 |
| Example 25 | A-25 | CG1 | 19-HT17 | 150 | 46 | ET1 | 75 | 2.0 | R2 | 175 | 0.24 |
| Comparative Example 1 | B-1 | CG1 | 11-HT1 | 50 | 22 | ET1 | 70 | 0.7 | R1 | 200 | 82.00 |
| Comparative Example 2 | B-2 | CG1 | 11-HT1 | 70 | 33 | ET1 | 40 | 1.8 | R1 | 196 | 2.30 |
| Comparative Example 3 | B-3 | CG1 | HT14 | 150 | 46 | ET1 | 75 | 2.0 | R1 | 152 | 0.33 |
| Comparative Example 4 | B-4 | CG1 | HT15 | 150 | 46 | ET1 | 75 | 2.0 | R1 | 152 | 0.23 |
| Comparative Example 5 | B-5 | CG1 | HT16 | 150 | 46 | ET1 | 75 | 2.0 | R1 | 181 | 3.30 |
| Comparative Example 6 | B-6 | CG1 | 11-HT1 | 320 | 68 | ET1 | 45 | 7.1 | R1 | Unmeasurable due to crystallization | Unmeasurable due to crystallization |
| Comparative Example 7 | B-7 | CG1 | 11-HT1 | 190 | 57 | ET1 | 40 | 4.8 | R1 | 158 | 0.38 |

TABLE 3

| | Photo-sensitive member | Black spot [count] | Exposure memory |
|---|---|---|---|
| Example 1 | A-1 | 10 | A |
| Example 2 | A-2 | 6 | C |
| Example 3 | A-3 | 15 | A |
| Example 4 | A-4 | 8 | A |
| Example 5 | A-5 | 6 | C |
| Example 6 | A-6 | 12 | A |
| Example 7 | A-7 | 8 | A |
| Example 8 | A-8 | 9 | A |
| Example 9 | A-9 | 3 | C |
| Example 10 | A-10 | 5 | C |
| Example 11 | A-11 | 8 | A |
| Example 12 | A-12 | 6 | A |
| Example 13 | A-13 | 7 | B |
| Example 14 | A-14 | 10 | B |
| Example 15 | A-15 | 15 | C |

TABLE 4

| | Photo-sensitive member | Black spot [count] | Exposure memory |
|---|---|---|---|
| Example 16 | A-16 | 10 | B |
| Example 17 | A-17 | 11 | A |
| Example 18 | A-18 | 8 | A |
| Example 19 | A-19 | 12 | B |
| Example 20 | A-20 | 8 | B |
| Example 21 | A-21 | 7 | A |
| Example 22 | A-22 | 12 | A |
| Example 23 | A-23 | 10 | A |
| Example 24 | A-24 | 6 | A |
| Example 25 | A-25 | 11 | A |
| Comparative Example 1 | B-1 | 5 | D |
| Comparative Example 2 | B-2 | 9 | D |
| Comparative Example 3 | B-3 | 56 | A |
| Comparative Example 4 | B-4 | 52 | A |
| Comparative Example 5 | B-5 | 13 | D |
| Comparative Example 6 | B-6 | Unmeasurable | Unmeasurable |
| Comparative Example 7 | B-7 | 35 | C |

Each of the photosensitive members (A-1) to (A-25) included a conductive substrate and a photosensitive layer of a single layer. The photosensitive layer contained a charge generating material, a hole transport material, an electron transport material, and a binder resin. The photosensitive layer had a Martens hardness at 50° C. of at least 160

N/mm$^2$. An optical response time was 0.05 milliseconds or longer and 0.85 milliseconds or shorter. Accordingly, the number of black spots produced through the use of any of the photosensitive members (A-1) to (A-25) was 15 or less as shown in Tables 3 and 4, which showed that black spot generation on a formed image was inhibited. Furthermore, each of the photosensitive members (A-1) to (A-25) was rated as any of A to C in evaluation of an image defect resulting from exposure memory, which showed that an image defect resulting from exposure memory was inhibited.

By contrast, the optical response time of each of the photosensitive members (B-1), (B-2), and (B-5) was over 0.85 milliseconds. Accordingly, each of the photosensitive members (B-1), (B-2), and (B-5) was rated as D in evaluation of an image defect resulting from exposure memory as shown in Table 4, which showed that an image defect resulting from exposure memory was not inhibited.

The photosensitive layer of each of the photosensitive members (B-3), (B-4), and (B-7) had a Martens hardness at 50° C. of less than 160 N/mm$^2$. Accordingly, the number of black spots produced through the use of any of the photosensitive members (B-3), (B-4), and (B-7) was 35 or larger as shown in Table 4, which showed that black spot generation on a formed image was not inhibited.

In the photosensitive member (B-6), the photosensitive layer was crystallized and an optical response time and a Martens hardness at 50° C. were therefore unmeasurable. Also in the photosensitive member (B-6), the photosensitive layer was crystallized, and therefore, black spot generation on a formed image and an image defect resulting from exposure memory could not be evaluated.

From the above, it was shown that the photosensitive member according to the present invention can inhibit black spot generation on a formed image and an image defect resulting from exposure memory. Furthermore, it was shown that the process cartridge and the image forming apparatus according to the present invention can also inhibit black spot generation on a formed image and an image defect resulting from exposure memory.

INDUSTRIAL APPLICABILITY

The photosensitive member according to the present invention can be utilized in image forming apparatuses. The process cartridge and the image forming apparatus according to the present invention can be utilized for image formation on a recording medium.

The invention claimed is:

1. An electrophotographic photosensitive member comprising:

a conductive substrate; and a photosensitive layer of a single layer, wherein the photosensitive layer contains a charge generating material, a hole transport material, an electron transport material, and a binder resin, an optical response time is 0.05 milliseconds or longer and 0.85 milliseconds or shorter, the optical response time is a time from irradiation of a surface of the photosensitive layer charged to +800 V with pulse light having a wavelength of 780 nm to decay of a surface potential of the photosensitive layer from +800 V to +400 V, the pulse light has an intensity that allows the surface potential of the photosensitive layer to decay to +200 V from +800 V after 400 milliseconds elapse from the irradiation of the surface of the photosensitive layer charged to +800 V with the pulse light, the photosensitive layer has a Martens hardness at 50° C. of at least 160 N/mm$^2$, and the hole transport material includes a compound represented by chemical formula (19-HT17) shown below:

(19-HT17)

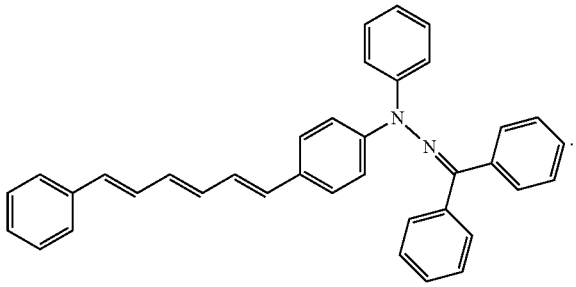

2. The electrophotographic photosensitive member according to claim 1, wherein the binder resin includes a polycarbonate resin including a repeating unit represented by general formula (1) shown below:

(1)

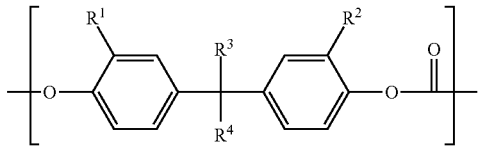

where in general formula (1), $R^1$, $R^2$, $R^3$, and $R^4$ each represent, independently of one another, a hydrogen atom, an alkyl group having a carbon number of at least 1 and no greater than 3 and optionally having a halogen atom, or an aryl group having a carbon number of at least 6 and no greater than 14, and $R^3$ and $R^4$ may be bonded together to represent a cycloalkylidene group having a carbon number of at least 5 and no greater than 7.

3. The electrophotographic photosensitive member according to claim 2, wherein the polycarbonate resin including the repeating unit represented by the general formula (1) is a polycarbonate resin including a repeating unit represented by chemical formula (R1), (R2), (R3), or (R4) shown below:

(R1)

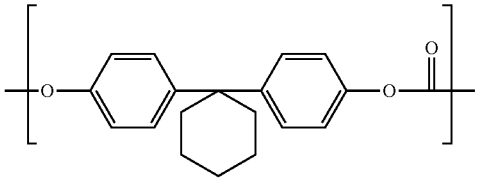

-continued (R2)

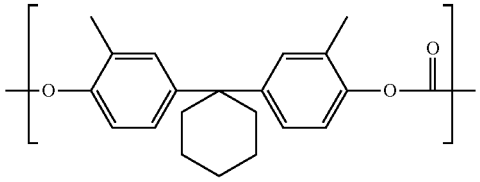

(R3)

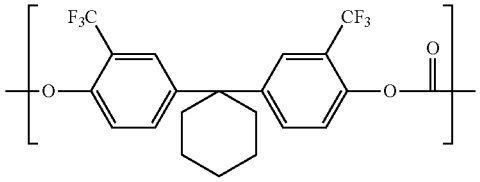

(R4)

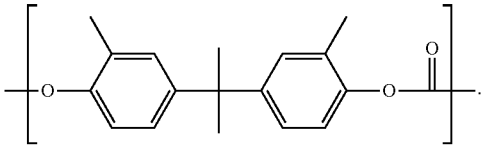

4. The electrophotographic photosensitive member according to claim 3, wherein the polycarbonate resin including the repeating unit represented by the general formula (1) is the polycarbonate resin including the repeating unit represented by the chemical formula (R2), (R3), or (R4).

5. The electrophotographic photosensitive member according to claim 1, wherein a ratio $m_{HTM}/m_{ETM}$ of mass $m_{HTM}$ of the hole transport material to mass $m_{ETM}$ of the electron transport material is at least 1.2 and no greater than 4.0.

6. The electrophotographic photosensitive member according to claim 1, wherein a content of the hole transport material relative to mass of the photosensitive layer is at least 35% by mass and no greater than 65% by mass.

7. The electrophotographic photosensitive member according to claim 1, wherein the optical response time is 0.05 milliseconds or longer and 0.70 milliseconds or shorter.

8. A process cartridge comprising:

at least one selected from the group consisting of a charger, a light exposure section, a developing section, and a transfer section; and the electrophotographic photosensitive member according to claim 1.

9. An image forming apparatus, comprising:

an image bearing member;

a charger configured to charge a surface of the image bearing member;

a light exposure section configured to expose the charged surface of the image bearing member to light to form an electrostatic latent image on the surface of the image bearing member;

a developing section configured to develop the electrostatic latent image into a toner image; and a transfer section configured to transfer the toner image onto a transfer target from the image bearing member, wherein the charger charges the surface of the image bearing member to a positive polarity, and the image bearing member is the electrophotographic photosensitive member according to claim 1.

10. The image forming apparatus according to claim 9, wherein the developing section is configured to develop the electrostatic latent image into the toner image within 100 milliseconds from a time when a specific portion of the surface of the image bearing member is exposed to light by the light exposure section.

11. The image forming apparatus according to claim 9, wherein the charger is configured to re-charge a region of the surface of the image bearing member from which the toner image has been transferred to the transfer target without the region being subjected to static elimination.

* * * * *